US009501005B2

(12) United States Patent
Okamoto et al.

(10) Patent No.: US 9,501,005 B2
(45) Date of Patent: Nov. 22, 2016

(54) FIXING DEVICE AND IMAGE FORMING APPARATUS

(71) Applicant: KONICA MINOLTA, INC., Chiyoda-ku, Tokyo (JP)

(72) Inventors: Akira Okamoto, Hino (JP); Kenji Yamamoto, Hachioji (JP); Keigo Ogura, Tokyo (JP); Takahiro Yokoya, Hachioji (JP); Hiroyuki Futami, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/674,987

(22) Filed: Mar. 31, 2015

(65) Prior Publication Data

US 2015/0286175 A1 Oct. 8, 2015

(30) Foreign Application Priority Data

Apr. 3, 2014 (JP) ..... 2014-077310

(51) Int. Cl.
*G03G 15/20* (2006.01)

(52) U.S. Cl.
CPC ..... *G03G 15/2039* (2013.01); *G03G 15/2042* (2013.01)

(58) Field of Classification Search
CPC ..... G03G 15/2042; G03G 15/2082
See application file for complete search history.

(56) References Cited

U.S. PATENT DOCUMENTS 5,747,777 A 5/1998 Matsuoka
2004/0256372 A1 12/2004 Yoshioka et al.
2009/0052927 A1* 2/2009 Yoshikawa ..... G03G 15/2039 399/69

(Continued)

FOREIGN PATENT DOCUMENTS

JP 04362713 A 12/1992
JP 05107983 A 4/1993

(Continued)

OTHER PUBLICATIONS

Extended European Search Report dated Aug. 25, 2015, issued in counterpart European Application No. 15156479.6.

(Continued)

*Primary Examiner* — Gregory H Curran
(74) *Attorney, Agent, or Firm* — Holtz, Holtz & Volek PC

(57) ABSTRACT

A fixing device includes a roller, a plurality of heaters, a temperature detection unit, and a control unit, wherein when the temperature detection unit detects that the temperature of longitudinal end portions of the roller is lower than a preset reference temperature, the control unit performs full-lighting control on the heater with the largest amount of heat supply to the end portions of the roller, out of the plurality of heaters, and performs lighting control on the heater with the second largest amount of heat supply to the end portions of the roller in a pattern at a predetermined duty ratio, or performs lighting control on the heater with the largest amount of heat supply to the end portions of the roller in a pattern at a predetermined duty ratio, and turns off the heater with the second largest amount of heat supply to the end portions of the roller.

16 Claims, 27 Drawing Sheets

(56) References Cited

U.S. PATENT DOCUMENTS

| | | | | |
|---|---|---|---|---|
| 2009/0196643 | A1* | 8/2009 | Mito | G03G 15/2039 399/69 |
| 2010/0061754 | A1 | 3/2010 | Ishigaya et al. | |
| 2013/0188997 | A1 | 7/2013 | Imai et al. | |

FOREIGN PATENT DOCUMENTS

| | | | |
|---|---|---|---|
| JP | 08278722 | A | 10/1996 |
| JP | 2001142543 | A | 5/2001 |
| JP | 2003098899 | A | 4/2003 |
| JP | 2003345169 | A | 12/2003 |
| JP | 2005055527 | A | 3/2005 |
| JP | 2007004040 | A | 1/2007 |
| JP | 2007310254 | A | 11/2007 |
| JP | 2013148721 | A | 8/2013 |

OTHER PUBLICATIONS

Japanese Office Action (and English translation thereof) dated Jul. 26, 2016, issued in counterpart Japanese Application No. 2014-077310.

* cited by examiner

FIG. 7A
FIG. 7B
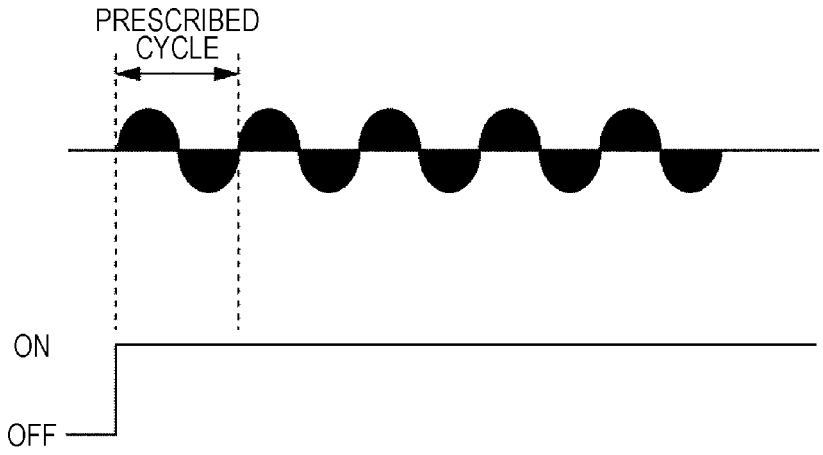
FIG. 8A
FIG. 8B
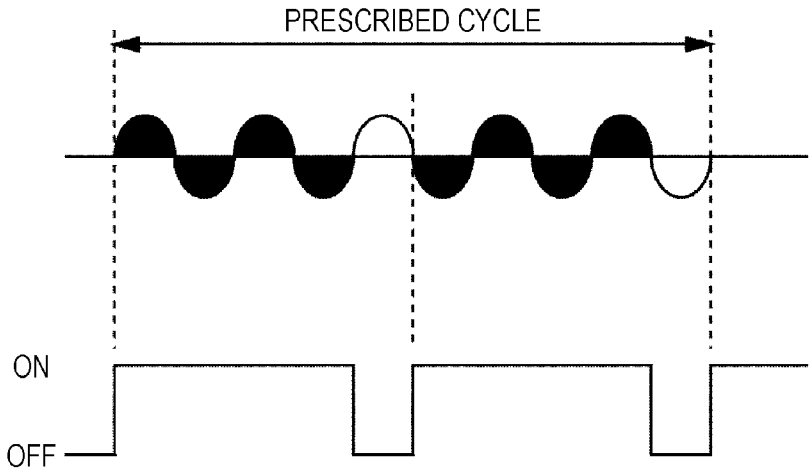

FIG. 9A
FIG. 9B
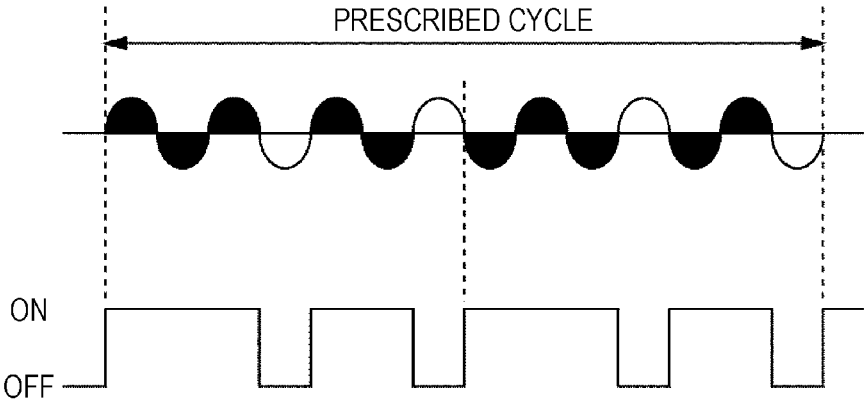
FIG. 10A
FIG. 10B
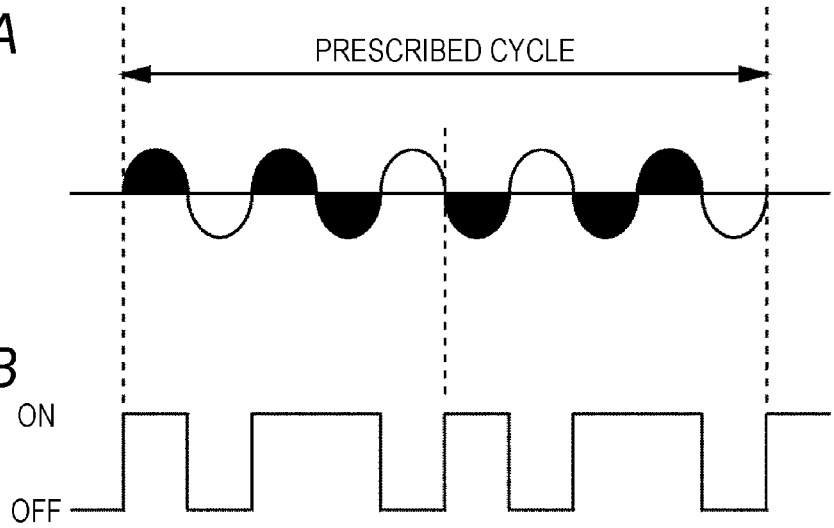

FIG. 20

TB1

| PATTERN | FLAT HEATER DUTY RATIO | FLAT HEATER POWER (W) | END HEATER DUTY RATIO | END HEATER POWER(W) | TOTAL POWER (W) | DUTY RATIO | FLAT HEATER | END HEATER | PI CALCULATED THRESHOLD (OR HIGHER) |
|---|---|---|---|---|---|---|---|---|---|
| | | 1000 | | 800 | 1800 | | | | |
| 1 | 100.00% | 1000 | 100.00% | 800 | 1800 | 100.00% | 100% LIGHTING | 100% LIGHTING | 350 |
| 2 | 100.00% | 1000 | 80.00% | 640 | 1640 | 91.11% | 100% LIGHTING | DUTY | 319 |
| 3 | 100.00% | 1000 | 71.43% | 571 | 1571 | 87.30% | 100% LIGHTING | DUTY | 306 |
| 4 | 100.00% | 1000 | 60.00% | 480 | 1480 | 82.22% | 100% LIGHTING | DUTY | 288 |
| 5 | 100.00% | 1000 | 55.56% | 444 | 1444 | 80.25% | 100% LIGHTING | DUTY | 281 |
| 6 | 100.00% | 1000 | 40.00% | 320 | 1320 | 73.33% | 100% LIGHTING | DUTY | 257 |
| 7 | 100.00% | 1000 | 33.33% | 213 | 1213 | 67.41% | 100% LIGHTING | DUTY | 236 |
| 8 | 100.00% | 1000 | 0.00% | 0 | 1000 | 55.56% | 100% LIGHTING | OFF | 194 |
| 9 | 80.00% | 800 | 0.00% | 0 | 800 | 44.44% | DUTY | OFF | 156 |
| 10 | 71.43% | 714 | 0.00% | 0 | 714 | 39.68% | DUTY | OFF | 139 |
| 11 | 60.00% | 600 | 0.00% | 0 | 600 | 33.33% | DUTY | OFF | 117 |
| 12 | 55.56% | 556 | 0.00% | 0 | 556 | 30.86% | DUTY | OFF | 108 |
| 13 | 40.00% | 400 | 0.00% | 0 | 400 | 22.22% | DUTY | OFF | 78 |
| 14 | 33.33% | 333 | 0.00% | 0 | 333 | 18.52% | DUTY | OFF | 65 |
| 15 | 0.00% | 0 | 0.00% | 0 | 0 | 0.00% | OFF | OFF | 64 OR LESS |

FIG. 21

TB2

| PATTERN | FLAT HEATER DUTY RATIO | FLAT HEATER POWER (W) | END HEATER DUTY RATIO | END HEATER POWER(W) | TOTAL POWER (W) | DUTY RATIO | FLAT HEATER | END HEATER | PI CALCULATED THRESHOLD (OR HIGHER) |
|---|---|---|---|---|---|---|---|---|---|
| | | 1000 | | 800 | 1800 | | | | |
| 1 | 100.00% | 1000 | 100.00% | 800 | 1800 | 100.00% | 100% LIGHTING | 100% LIGHTING | 350 |
| 2 | 80.00% | 800 | 100.00% | 800 | 1600 | 88.89% | DUTY | 100% LIGHTING | 311 |
| 3 | 71.43% | 714 | 100.00% | 800 | 1514 | 84.13% | DUTY | 100% LIGHTING | 294 |
| 4 | 60.00% | 600 | 100.00% | 800 | 1400 | 77.78% | DUTY | 100% LIGHTING | 272 |
| 5 | 55.56% | 556 | 100.00% | 800 | 1356 | 75.31% | DUTY | 100% LIGHTING | 264 |
| 6 | 40.00% | 400 | 100.00% | 800 | 1200 | 66.67% | DUTY | 100% LIGHTING | 233 |
| 7 | 33.33% | 267 | 100.00% | 800 | 1067 | 59.26% | DUTY | 100% LIGHTING | 207 |
| 8 | 0.00% | 0 | 100.00% | 800 | 800 | 44.44% | OFF | 100% LIGHTING | 156 |
| 9 | 0.00% | 0 | 80.00% | 640 | 640 | 35.56% | OFF | DUTY | 124 |
| 10 | 0.00% | 0 | 71.43% | 571.428571 | 571 | 31.75% | OFF | DUTY | 111 |
| 11 | 0.00% | 0 | 60.00% | 480 | 480 | 26.67% | OFF | DUTY | 93 |
| 12 | 0.00% | 0 | 55.56% | 444.444444 | 444 | 24.69% | OFF | DUTY | 86 |
| 13 | 0.00% | 0 | 40.00% | 320 | 320 | 17.78% | OFF | DUTY | 62 |
| 14 | 0.00% | 0 | 33.33% | 266.666667 | 267 | 14.81% | OFF | DUTY | 52 |
| 15 | 0.00% | 0 | 0.00% | 0 | 0 | 0.00% | OFF | OFF | 51 OR LESS |

FIXING DEVICE AND IMAGE FORMING APPARATUS

The entire disclosure of Japanese Patent Application No. 2014-077310 filed on Apr. 3, 2014 including description, claims, drawings, and abstract are incorporated herein by reference in its entirety.

BACKGROUND OF THE INVENTION

1. Field of the Invention

The present invention relates to a fixing device and an image forming apparatus.

2. Description of the Related Art

Conventionally, electrophotographic image forming apparatuses such as printers, photocopiers, and facsimiles have been widely used. At an image forming apparatus of this type, an image is transferred from an image forming part to paper conveyed from a paper feed part, and then the image is fixed to the paper by a fixing device. The fixing device includes a heating roller with a plurality of heaters therein and a pressure roller to be brought into contact with the heating roller under pressure. The heaters are halogen lamps, for example.

In recent years, there have been increasing demands for energy saving in image forming apparatuses. Thus, to achieve energy saving in image forming apparatuses, the fixing device has been thinned at a core constituting the fixing roller to reduce the heat capacity of the fixing part. However, when the fixing roller has the thinned core as described above, the heat escapes from support members supporting the both end portions of the fixing roller, and the temperature of the fixing roller tends to be lower at the end portions than at the central portion thereof. As a result, temperature variations occur on the surface of the fixing roller to increase temperature ripples on the fixing roller.

To cope with these problems, for example, JP 2007-310254 A discloses an image forming apparatus that sets the power ratio of a sub heater upon energization corresponding to the power ratio of a main heater, according to the temperature of the end portions of the fixing roller detected by a second temperature detecting unit. In addition, JP 2013-148721 A discloses a fixing device that, in the case of feeding small-sized paper, causes a sub heater to start PID temperature control, and decides the initial lighting ratio at the start of the PID temperature control by the sub heater according to the difference between the temperature detected by each temperature detecting unit at the start of the control and the target paper-feed temperature for printing jobs.

However, the fixing devices described in JP 2007-310254 A and JP 2013-148721 A have problems described below. Specifically, at the image forming apparatus disclosed in JP 2007-310254 A, both the main heater and the sub heater are subjected to lighting control in half-wave on/off patterns. However, the lighting control is not conducted in the on/off patterns at the optimum duty ratios, and thus the temperature of the end portions of the fixing roller does not increase, which brings about unevenness in the temperature of the entire fixing roller. In addition, the simultaneous duty controls of the main heater and the sub heater lead to complicated operations. At the fixing device disclosed in JP 2013-148721 A, for feeding of small-sized paper, the main heater is turned off and the sub heater conducts the PID temperature control, which causes problems such as temperature non-uniformity of the fixing roller and occurrence of temperature ripples on the fixing roller.

SUMMARY OF THE INVENTION

An object of the present invention is to provide a fixing device and an image forming apparatus that reduce a load of lighting control and ensure uniform temperature of the fixing roller.

To achieve the abovementioned object, according to an aspect, a fixing device reflecting one aspect of the present invention comprises: a roller that fixes an image onto paper; a plurality of heaters that is provided within the roller and is configured to be different in distribution of heat supply amount along a longitudinal side of the roller; a temperature detection unit that detects the temperature of the roller; and a control unit that performs lighting control on the heaters in patterns of half-wave cycles of an alternating-current power source according to results of the detection by the temperature detection unit, wherein, when the temperature detection unit detects that the temperature of the end portions of the roller along the longitudinal side is lower than a preset reference temperature, the control unit performs full-lighting control on the heater with the largest amount of heat supply to the end portions of the roller, out of the plurality of heaters, and performs lighting control on the heater with the second largest amount of heat supply to the end portions of the roller, out of the plurality of heaters, in a pattern at a predetermined duty ratio, or performs lighting control on the heater with the largest amount of heat supply to the end portions of the roller, out of the plurality of heaters, in a pattern at a predetermined duty ratio, and turns off the heater with the second largest amount of heat supply to the end portions of the roller, out of the plurality of heaters.

To achieve the abovementioned object, according to an aspect, a fixing device reflecting one aspect of the present invention comprises: a roller that fixes an image onto paper; a plurality of heaters that is provided within the roller and is configured to be different in distribution of heat supply amount along a longitudinal side of the roller; a temperature detection unit that detects the temperature of the roller; and a control unit that performs lighting control on the heaters in patterns of half-wave cycles of an alternating-current power source according to results of the detection by the temperature detection unit, wherein, when the temperature detection unit detects that the temperature of the end portions of the roller along the longitudinal side is higher than a preset reference temperature, the control unit performs full-lighting control on the heater with the least amount of heat supply to the end portions of the roller, out of the plurality of heaters, and performs lighting control on the heater with the second least amount of heat supply to the end portions of the roller, out of the plurality of heaters, in a pattern at a predetermined duty ratio, or performs lighting control on the heater with the least amount of heat supply to the end portions of the roller, out of the plurality of heaters, in a pattern at a predetermined duty ratio, and turns off the heater with the second least amount of heat supply to the end portions of the roller, out of the plurality of heaters.

The image forming apparatus according to an aspect of the present invention preferably includes an image forming part that forms an image on paper, and the foregoing fixing device that fixes the image formed by the image forming part onto the paper.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIGS. 7A and 7B are diagrams showing an exemplary arrangement of a duty pattern at a duty ratio of 100%;

FIGS. 8A and 8B are diagrams showing an exemplary arrangement of a duty pattern at a duty ratio of 80%;

FIGS. 9A and 9B are diagrams showing an exemplary arrangement of a duty pattern at a duty ratio of 71.43%;

FIGS. 10A and 10B are diagrams showing an exemplary arrangement of a duty pattern at a duty ratio of 60%;

FIG. 20 is a diagram showing an exemplary configuration of a table storing duty patterns for heaters selected in the flat mode;

FIG. 21 is a diagram showing an exemplary configuration of a table storing duty patterns for heaters selected in the end heat up mode;

DESCRIPTION OF THE PREFERRED EMBODIMENTS

Figure 1:
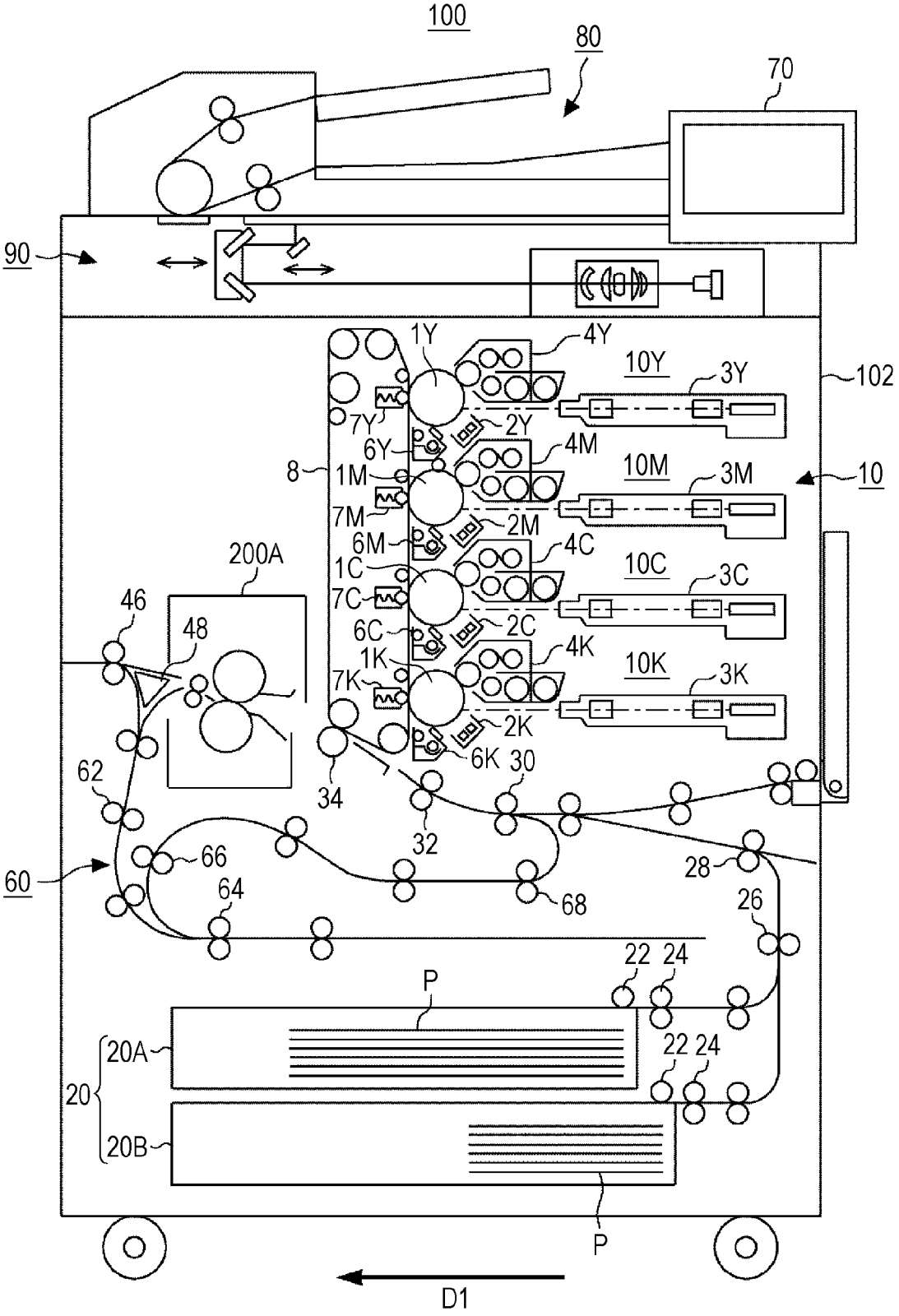
FIG. 1 is a diagram showing an exemplary configuration of an image forming apparatus according to a first embodiment.

Hereinafter, a preferred embodiment of the present invention will be described in detail with reference to the drawings. However, the scope of the invention is not limited to the illustrated examples. In the specification and drawings, the components having substantially similar functions and construction will be given the same reference numerals, and thus descriptions thereof will be omitted.

First Embodiment

[Example of a Configuration of an Image Forming Apparatus]

First, an image forming apparatus 100 of a first embodiment will be described. FIG. 1 shows an example of a configuration of the image forming apparatus 100 of the first embodiment. In relation to the embodiments of the present invention, the conveying direction of paper P will be called paper conveying direction D1, and the direction orthogonal to the paper conveying direction D1 will be called paper width direction D2.

As shown in FIG. 1, the image forming apparatus 100 is a so-called tandem image forming apparatus, which includes an automatic document conveying part 80 and a device main body 102. The automatic document conveying part 80 is mounted on the top of the device main body 102 and is configured to feed paper on a conveying stage by a conveying roller and the like to an image reading part 90 of the device main body 102.

The device main body 102 has an operation display part 70, the image reading part 90, an image forming part 10, an intermediate transfer belt 8, a paper feed part 20, a resist roller pair 32, a fixing device 200A, an auto duolex unit 60 (hereinafter, referred to as ADU).

The operation display part 70 has a touch panel with a combination of a display part and an input part, and a plurality of operation keys including a start key and a decision key around the touch panel. The operation display part 70 is configured to display a menu screen or the like on a screen or accept information such as image forming conditions and fixing conditions entered through a touch operation or a press of an operation key on the menu screen.

The image reading part 90 is configured to scan and expose to light an original document placed on a platen or conveyed from the automatic document conveying part 80, by an optical system of a scan/exposure device, and subjects an image on the scanned original document to photoelectric conversion by a CCD (charge coupled devices) image sensor to generate an image information signal. The image information signal is output to the image forming part 10 through analog processing, analog/digital (hereinafter, referred to as A/D) conversion, shading correction, image compression, and the like.

The image forming part 10 is configured to form an image by electrophotography. The image forming part 10 has an image forming unit 10Y that forms an image in yellow (Y), an image forming unit 10M that forms an image in magenta (M), an image forming unit 10C that forms an image in cyan (C), and an image forming unit 10K in black (K). In this example, the codes Y, M, C, and K indicative of the corresponding colors are appended to the reference numerals of the common functional components such as 10.

The image forming unit 10Y has a photoreceptor drum 1Y, and a charger 2Y, an exposure part (optical writing part) 3Y, a developer 4Y, and a cleaning part 6Y, which are arranged around the photoreceptor drum 1Y. The image forming unit 10M has a photoreceptor drum 1M, and a charger 2M, an exposure part 3M, a developer 4M, and a cleaning part 6M, which are arranged around the photoreceptor drum 1M. The image forming unit 10C has a photoreceptor drum 1C, and a charger 2C, an exposure part 3C, a developer 4C, and a cleaning part 6C, which are arranged around the photoreceptor drum 1C. The image forming unit 10K has a photoreceptor drum 1K, and a charger 2K, an exposure part 3K, a developer 4K, and a cleaning part 6K, which are arranged around the photoreceptor drum 1K.

The photoreceptor drums 1Y, 1M, 1C, 1K, the chargers 2Y, 2M, 2C, 2K, the exposure parts 3Y, 3M, 3C, 3K, the developers 4Y, 4M, 4C, 4K, and the cleaning parts 6Y, 6M, 6C, and 6K of the image forming units 10Y, 10M, 10C, and 10K are common in configuration, respectively. Hereinafter, unless otherwise required for discrimination, the foregoing components will be described without the codes Y, M, C, or K.

The charger 2 electrically charges the surface of the photoreceptor drum 1 in an almost uniform manner. The exposure part 3 is composed of an LPH (LED print head) with an LED array and an imaging lens and a polygon-mirror laser exposure scanning device, for example, and scans the photoreceptor drum 1 by laser light according to an image information signal to form an electrostatic latent image. The developer 4 develops by toner the electrostatic latent image on the photoreceptor drum 1. Accordingly, a toner image is formed as a visible image on the photoreceptor drum 1.

The intermediate transfer belt 8 is extended by a plurality of rollers and is turnably supported by the plurality of rollers. As the intermediate transfer belt 8 turns, a primary transfer roller 7 and the photoreceptor drum 1 rotate. Then, a predetermined voltage is applied between the primary transfer roller 7 and the photoreceptor drum 1 to transfer the toner image from the photoreceptor drum 1 to the intermediate transfer belt 8 (primary transfer).

The paper feed part 20 has a plurality of paper feed trays 20A and 20B storing A3 or A4 paper P. The paper P is conveyed from the paper feed trays 20A and 20B to conveying rollers 22, 24, 26, and 28, and then is conveyed to a loop roller pair 30. The number of the paper feed trays is not limited to two. In addition, one or more large-capacity paper feed devices accommodating a large amount of paper P may be coupled as necessary.

When being conveyed to the loop roller pair 30, the paper P abuts at its leading end against a resist roller pair 32. The resist roller pair 32 forms a loop in the abutted paper P and corrects a bent (for example, a skew) in the paper P relative to the paper conveying direction D1. The paper P corrected in the bent is conveyed to a secondary transfer roller 34 at a predetermined timing. The secondary transfer roller 34 transfers collectively the toner images in Y, M, C, and K transferred to the intermediate transfer belt 8, to the surface of the paper P conveyed from the resist roller pair 32 (secondary transfer). The paper P having undergone the secondary transfer is conveyed to the fixing device 200A on the downstream side of the paper conveying direction D1.

The fixing device 200A performs a pressurization process and a heating process on the paper P to which the toner images are transferred by the secondary transfer roller 34 to fix the toner images onto the surface of the paper P. The fixing device 200A will be described later. A conveyance path switch unit 48 is provided on the downstream side of the fixing device 200A along the paper conveying direction D1 to switch the conveyance path for the paper P to the paper ejection path side or the ADU 60 side. The conveyance path switch unit 48 performs conveyance path switch control depending on a selected print mode (single-side print mode, double-side print mode, or the like).

After completion of single-side printing in the single-side print mode or after completion of double-side printing in the double-side print mode, the paper P is ejected by the paper ejection roller 46 onto the paper ejection tray. When an image is to be formed on the back side of the paper P in the double-side print mode, the paper P with an image formed on the front side is conveyed to the ADU 60 through the conveying roller 62 and the like. In a switch-back path of the ADU 60, the paper P is conveyed from its trailing end to a U-turn path portion under reverse control by the ADU roller 64. Then, the paper P turned upside down is fed again to the secondary transfer roller 34 by conveying rollers 66, 68, and the like at the U-turn path portion.

[Configuration Example of the Fixing Device]

Figure 2:
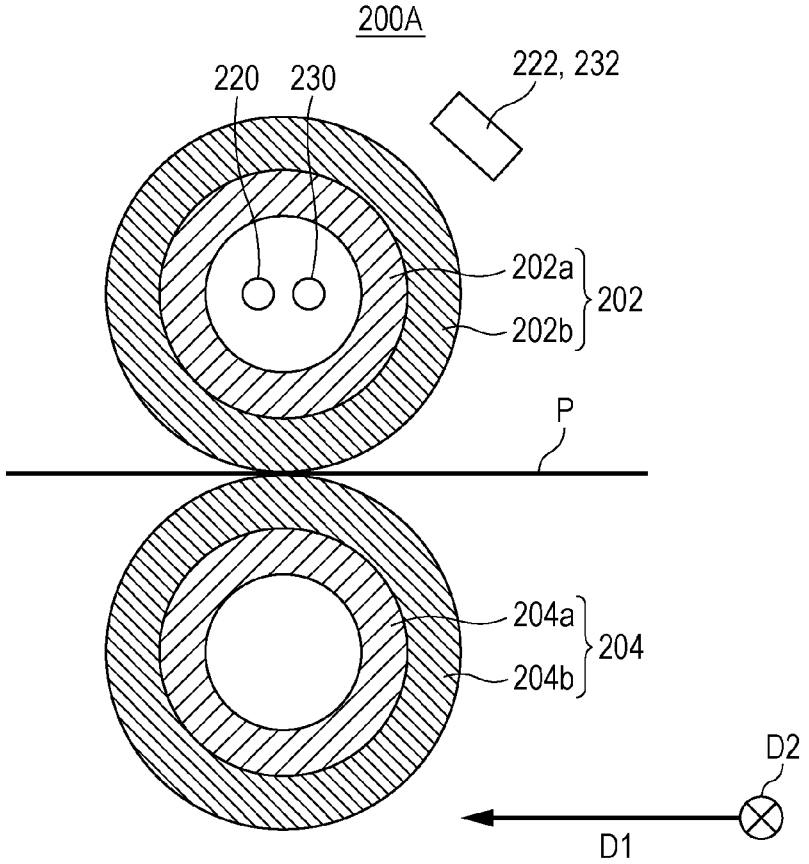
FIG. 2 is a cross-sectional view showing an exemplary configuration of a fixing device (No. 1)
Figure 3:
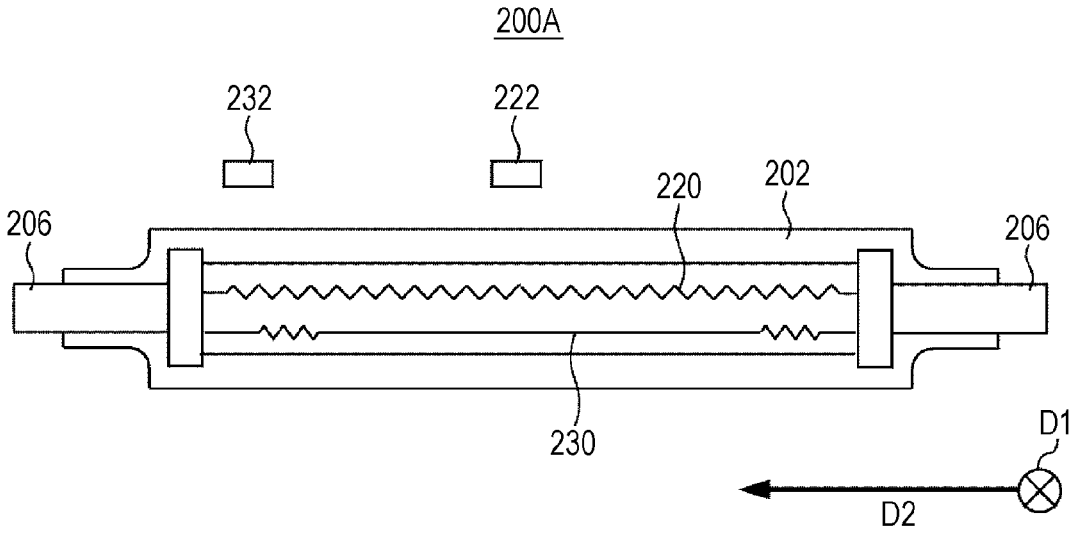
FIG. 3 is a cross-sectional view showing an exemplary configuration of the fixing device (No. 2)
Figure 4A:
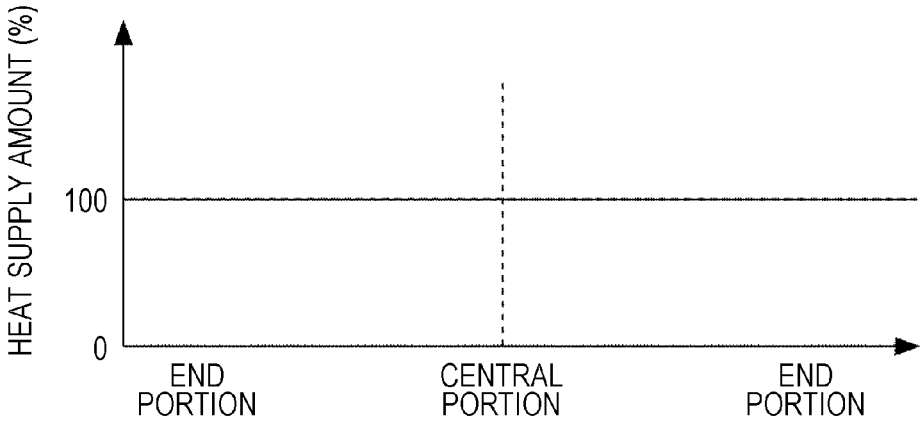
FIGS. 4A and 4B are diagrams showing distributions of heat supply amounts of heaters constituting the fixing device.
Figure 4B:
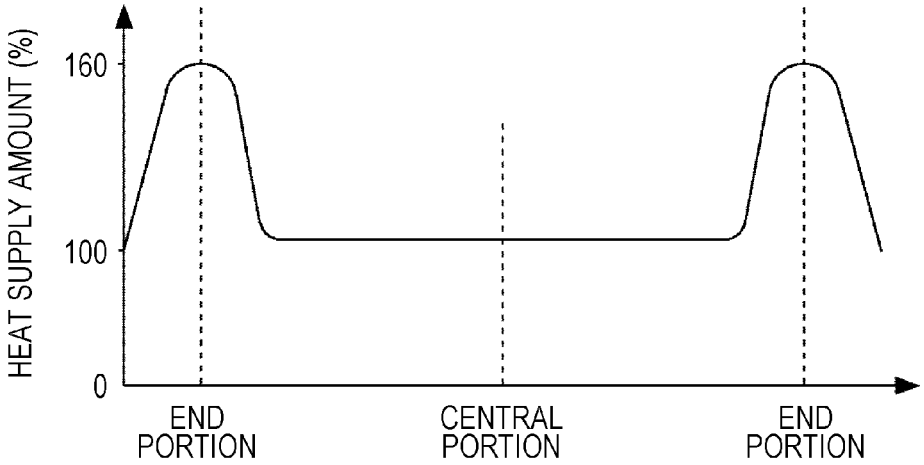

Next, a schematic configuration example of the fixing device 200A will be described. FIG. 2 is a cross-sectional view showing an exemplary configuration of the fixing device 200A as seen from the paper width direction D2. FIG. 3 is a cross-sectional view showing an exemplary configuration of the fixing device 200A as seen from the paper conveying direction D1. FIG. 4A is a diagram showing a distribution of heat supply amount of a flat heater 220. FIG. 4B is a diagram showing a distribution of heat supply amount of an end heater 230.

As illustrated in FIGS. 2 and 3, the fixing device 200A includes a heating roller (fixing roller) 202, a pressure roller 204, a central temperature detection unit 222, and an end temperature detection unit 232. The heating roller 202 has a cylindrical core 202*a* and a functional layer 202*b* composed of a resin layer, an elastic layer, and the like covering the outer periphery (surface) of the core 202*a*. In this example, the thinned core 202*a* is used to facilitate transfer of heat from the flat heater 220 and the end heater 230 arranged inside the heating roller 202. The both end portions of the heating roller 202 are supported by support members 206.

The flat heater 220 and the end heater 230 are composed of halogen heaters, for example, and are arranged inside the core 202*a* of the heating roller 202. The flat heater 220 is arranged along the longitudinal side (axial direction) of the heating roller 202 and is almost identical in length to the heating roller 202 along the longitudinal side. The flat heater 220 is configured in such a manner that the distribution of heat supply amount is uniform (for example, 100%) in the entire paper feed path including the central and end portions of the heating roller 202 along the longitudinal side, as illustrated in FIG. 4A.

The end heater 230 is arranged along the longitudinal side of the heating roller 202 and is made almost identical in length to the heating roller 202 along the longitudinal side. The end heater 230 is configured in such a manner that the distributions of heat supply amount to the both longitudinal end portions of the heating roller 202 are the largest, as illustrated in FIG. 4B. Specifically, the amount of heat supply to the central portion of the end heater 230 is configured at 100%, and the amount of heat supply to the end portions of the end heater 230 is configured at 160% which is larger by 60% than the amount of heat supply to the central portion. The end portions of the heating roller 202 include the areas other than the paper feed path through which the paper P with a small size such as A4S passes, for example.

The pressure roller 204 has a cylindrical core 204*a* and a functional layer 204*b* composed of a resin layer, an elastic layer, and the like covering the outer periphery (surface) of the core 204*a*. The pressure roller 204 is capable of being brought into contact with the heating roller 202 under pressure.

The central temperature detection unit 222 is arranged in the vicinity of the central portion of the heating roller 202 along the longitudinal side to detect the temperature of the central portion of the heating roller 202. The end temperature detection unit 232 is arranged in the vicinity of one end portion of the heating roller 202 along the longitudinal side to detect the temperature of the end portion of the heating roller 202. The central temperature detection unit 222 and the end temperature detection unit 232 may be thermistors, for example.

[Block Configuration Example of the Fixing Device]

Figure 5:
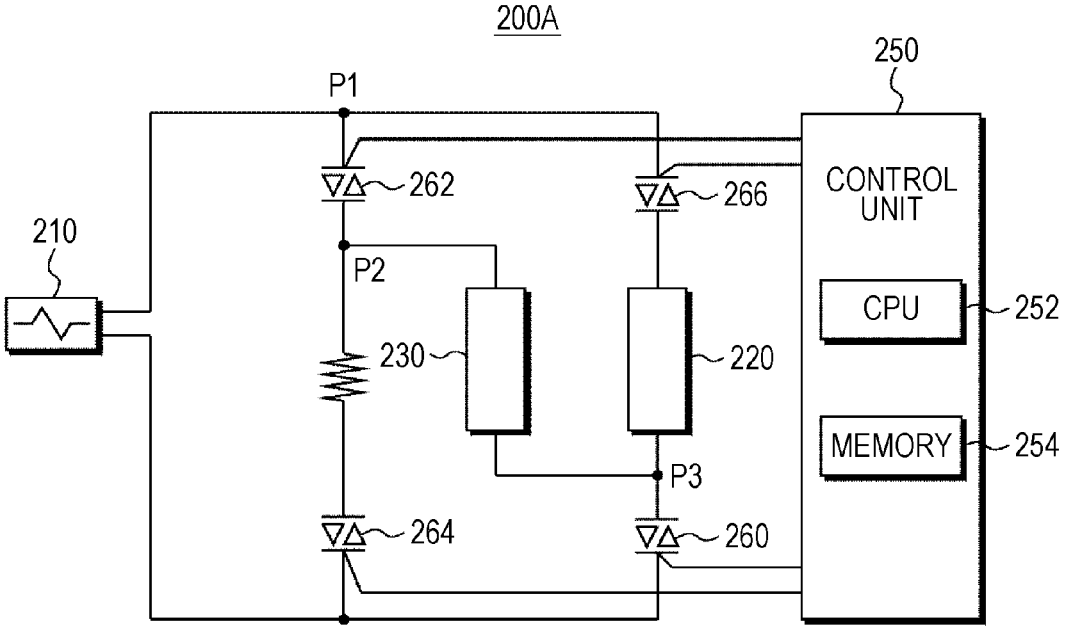
FIG. 5 is a block diagram showing an exemplary circuit configuration of the fixing device.

Next, a circuit configuration of the fixing device 200A will be described. FIG. 5 shows an example of a circuit configuration of the fixing device 200A. The fixing device 200A in an embodiment of the present invention is composed of a series-parallel lighting circuit that subjects the flat heater 220 and the end heater 230 to series lighting, parallel lighting, or single lighting.

The fixing device 200A includes an alternating-current power source unit 210, the flat heater 220, the end heater 230, a control unit 250, triacs 260, 262, 264, and 266 as examples of switching elements, as illustrated in FIG. 5. The triacs 262 and 266 are connected in parallel to a connection point P1 connected to the alternating-current power source unit 210.

The flat heater 220 is connected at one end to the triac 266 and connected at the other end to a connection point P3. The connection point P3 is provided between the flat heater 220 and the triac 260. The flat heater 220 is turned on/off according to a half-wave duty pattern supplied from the control unit 250 through the triac 266 and the like.

The end heater 230 is connected at one end to a connection point P2 and connected at the other end to the connection point P3. The connection point P2 is provided between the triac 262 and the triac 264. The end heater 230 is turned on/off according to a half-wave duty pattern provided from the control unit 250 through the triac 262 and the like.

The control unit 250 has a CPU (central processing unit) 252 that controls the entire operations of the fixing device 200A, and a memory 254 such as a ROM (read only memory) or a RAM (random access memory). The CPU 252 executes software (programs) read from the memory 254 to control the components such as the fixing device 200A of the image forming apparatus 100 and realize functions related to lighting control of the flat heater 220 and the end heater 230.

In this example, the control unit 250 sets a flat mode and an end heat up mode for lighting control of the flat heater 220 and the end heater 230 in the fixing process. The flat mode is intended to, when the temperature of the end portions of the heating roller 202 exceeds a specific temperature (reference temperature), keep uniform the temperature of the entire heating roller 202. The end heat up mode is intended to, when the temperature of the end portions of the heating roller 202 is equal to or lower than the specific temperature (reference temperature), heat up the end portions of the heating roller 202 preferentially to make uniform the temperature of the entire heating roller 202.

Figure 6A:
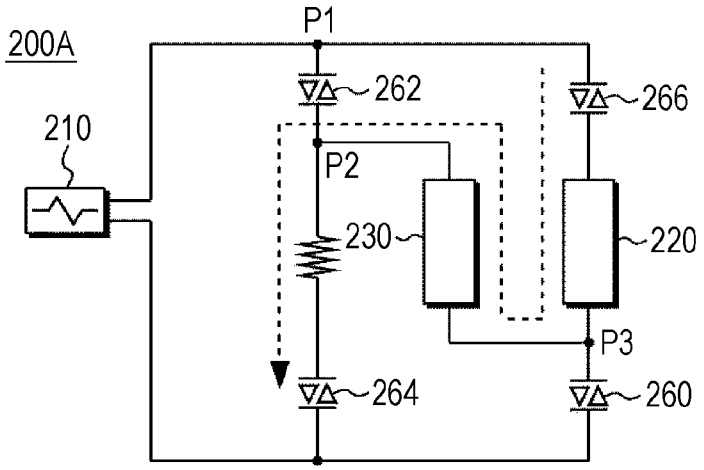
FIGS. 6A to 6C are diagrams for describing series lighting, parallel lighting, and single lighting at the fixing device.
Figure 6B:
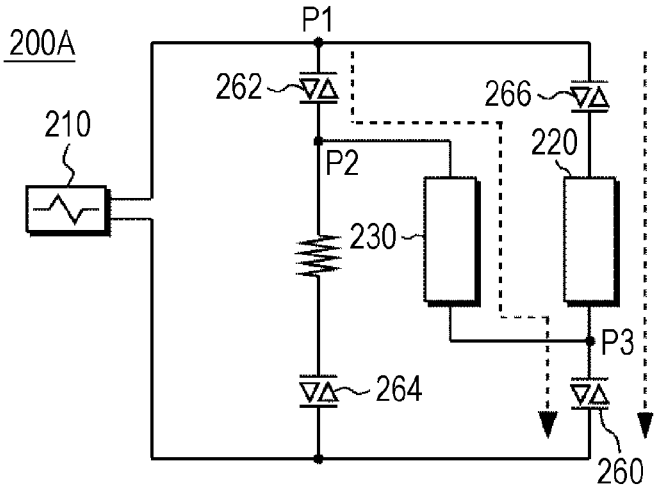
Figure 6C:
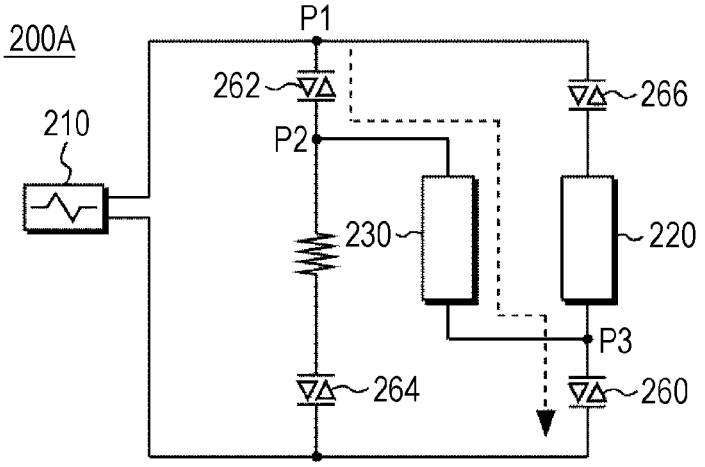

Next, descriptions will be given as to the case where the flat heater 220 and the end heater 230 are subjected to series lighting, parallel lighting, or single lighting in the series-parallel circuit of the fixing device 200A described above. FIG. 6A illustrates an example of a circuit configuration for series lighting of the flat heater 220 and the end heater 230. In FIGS. 6A to 6C, the flows of electric current (power) are indicated by dashed lines.

To subject the flat heater 220 and the end heater 230 to series lighting, the control unit 250 supplies a control signal to the triacs 264 and 266 to turn on the flat heater 220 and the end heater 230, as illustrated in FIG. 6A. The circuit configuration allows the flat heater 220 and the end heater 230 to be connected in series and subjected to the flat heater 220 and the end heater 230 to series lighting. For example, the circuit configuration can be used to prevent an inrush current resulting from a large load change at the time of lighting of the fixing device 200A (at the time of lower-temperature activation).

FIG. 6B illustrates an example of a circuit configuration for parallel lighting of the flat heater 220 and the end heater 230. To subject the flat heater 220 and the end heater 230 to parallel lighting, the control unit 250 supplies a control signal to the triacs 260, 262, and 266 to turn on the triacs 260, 262, and 266 as illustrated in FIG. 6B. The circuit configuration allows the flat heater 220 and the end heater 230 to be connected in parallel and subjected to parallel lighting.

According to the circuit configuration, at least one of the flat heater 220 and the end heater 230 is subjected to lighting control in a half-wave duty pattern corresponding to a predetermined duty ratio, which allows fine power control. For example, the circuit configuration can be used to suppress temperature ripples, flickers, and the like in the fixing process. The circuit configuration can also be used to keep uniform the temperature of the end heater 230 after having reached the target temperature.

FIG. 6C illustrates an example of a circuit configuration for single lighting of the end heater 230. As illustrated in FIG. 6C, the control unit 250 supplies a control signal to the triacs 260 and 262 to turn on the triacs 260 and 262. The circuit configuration is for single lighting of the end heater 230 and allows the end heater 230 to be subjected to single lighting. To subject the flat heater 220 to single lighting, the triacs 260 and 266 are turned on.

According to the circuit configuration, it is possible to subject the end heater 230 to lighting control in a half-wave duty pattern corresponding to a predetermined duty ratio. This allows fine on/off control of the end heater 230. For example, the circuit configuration can be used to keep uniform the temperature of the end heater 230 having reached the target temperature.

[Arrangement Examples of Duty Patterns]

Next, descriptions will be given as to arrangement examples of half-wave duty patterns that make it possible to suppress influence of flicker. The half-wave duty patterns in the embodiment of the present invention have the following common features. That is, each of the duty patterns is configured in such a manner that the flat heater 220 and others are subjected to on/off control according to half waves of the alternating-current power source, the number of cycles is an odd number that is triple or more integration multiple of the half-wave cycle, and on sections or off sections in smaller in total number are all discontinuous in prescribed cycles.

Hereinafter, descriptions will be given as to specific arrangement examples of duty patterns at duty ratios 100%, 80%, 71.43%, 60%, 55.56%, 40%, and 33.33%. In the duty pattern at the duty ratio of 100%, all of the sections are on sections and thus this pattern is not applicable to the arrangements described above, but is included in the following description for explanatory purpose.

FIG. 7A illustrates a waveform of a half-wave duty pattern at a duty ratio of 100%, and FIG. 7B illustrates on/off states in the duty pattern. In FIG. 7A, the solid waveforms indicate lighted (on) states and the void waveforms indicate unlighted (off) states. The same thing is also applied to FIGS. 8 to 13. As illustrated in FIGS. 7A and 7B, all of the half-waves are set to on state at a duty ratio of 100%.

FIG. 8A illustrates a waveform in a half-wave duty pattern at a duty ratio of 80%, and FIG. 8B illustrates on/off states in the duty pattern. As illustrated in FIGS. 8A and 8B, when the duty ratio is 80%, the number of cycles is an odd number (five) that is triple or larger integration multiple of the half-wave cycle. The five half-waves are regarded as one block and four of the five half-waves are set to on state. The waves of the off sections in smaller in total number are arranged discontinuously so as not to be adjacent to each other.

FIG. 9A illustrates a waveform in a half-wave duty pattern at a duty ratio of 71.43%, and FIG. 9B illustrates on/off states in the duty pattern. As illustrated in FIGS. 9A and 9B, when the duty ratio is 71.43%, the number of cycles is an odd number (seven) that is triple or larger integration multiple of the half-wave cycle. The seven half-waves are regarded as one block and five of the seven half-waves are set to on state. The waves of the off sections in smaller in total number are arranged discontinuously so as not to be adjacent to each other.

FIG. 10A illustrates a waveform in a half-wave duty pattern at a duty ratio of 60%, and FIG. 10B illustrates on/off states in the duty pattern. As illustrated in FIGS. 10A and 10B, when the duty ratio is 60%, the number of cycles is an odd number (five) that is triple or larger integration multiple of the half-wave cycle. The five half-waves are regarded as one block and three of the five half-waves are set to on state. The waves of the off sections in smaller in total number are arranged discontinuously so as not to be adjacent to each other.

Figure 11A:
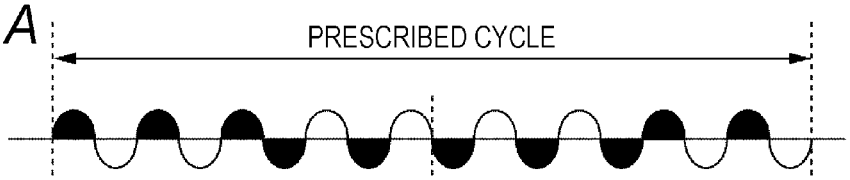
FIGS. 11A and 11B are diagrams showing an exemplary arrangement of a duty pattern at a duty ratio of 55.56%.
Figure 11B:
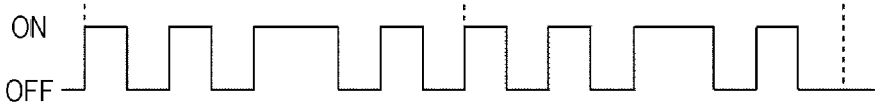

FIG. 11A illustrates a waveform in a half-wave duty pattern at a duty ratio of 55.56%, and FIG. 11B illustrates on/off states in the duty pattern. As illustrated in FIGS. 11A and 11B, when the duty ratio is 55.56%, the number of cycles is an odd number (nine) that is triple or larger integration multiple of the half-wave cycle. The nine half-waves are regarded as one block and five of the nine half-waves are set to on state. The waves of the off sections in smaller in total number are arranged discontinuously so as not to be adjacent to each other.

Figure 12A:
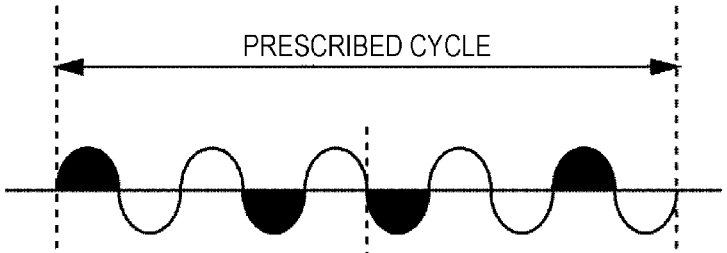
FIGS. 12A and 12B are diagrams showing an exemplary arrangement of a duty pattern at a duty ratio of 40%.
Figure 12B:
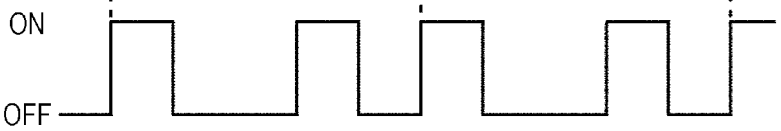

FIG. 12A illustrates a waveform in a half-wave duty pattern at a duty ratio of 40%, and FIG. 12B illustrates on/off states in the duty pattern. As illustrated in FIGS. 12A and 12B, when the duty ratio is 40%, the number of cycles is an odd number (five) that is triple or larger integration multiple of the half-wave cycle. The five half-waves are regarded as one block and two of the five half-waves are set to on state. The waves of the off sections in smaller in total number are arranged discontinuously so as not to be adjacent to each other.

Figure 13A:
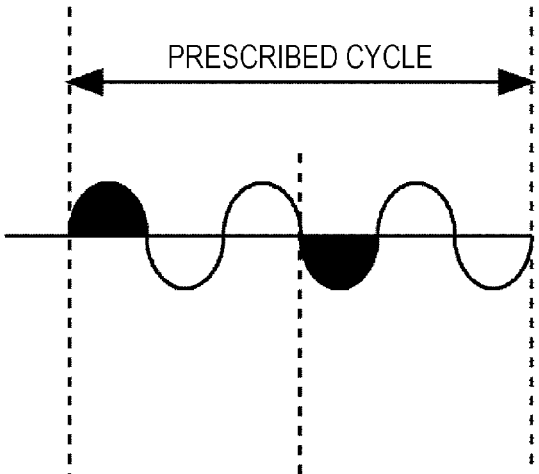
FIGS. 13A and 13B are diagrams showing an exemplary arrangement of a duty pattern at a duty ratio of 33.33%.
Figure 13B:
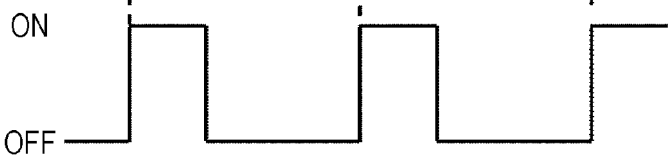

FIG. 13A illustrates a waveform in a half-wave duty pattern at a duty ratio of 33.33%, and FIG. 13B illustrates on/off states in the duty pattern. As illustrated in FIGS. 13A and 13B, when the duty ratio is 33.33%, the number of cycles is an odd number (three) that is triple or larger integration multiple of the half-wave cycle. The three half-waves are regarded as one block and one of the three half-waves is set to on state. The waves of the off sections in smaller in total number are arranged discontinuously so as not to be adjacent to each other.

[Example of a Timing Chart in the Flat Mode]

Figure 14:
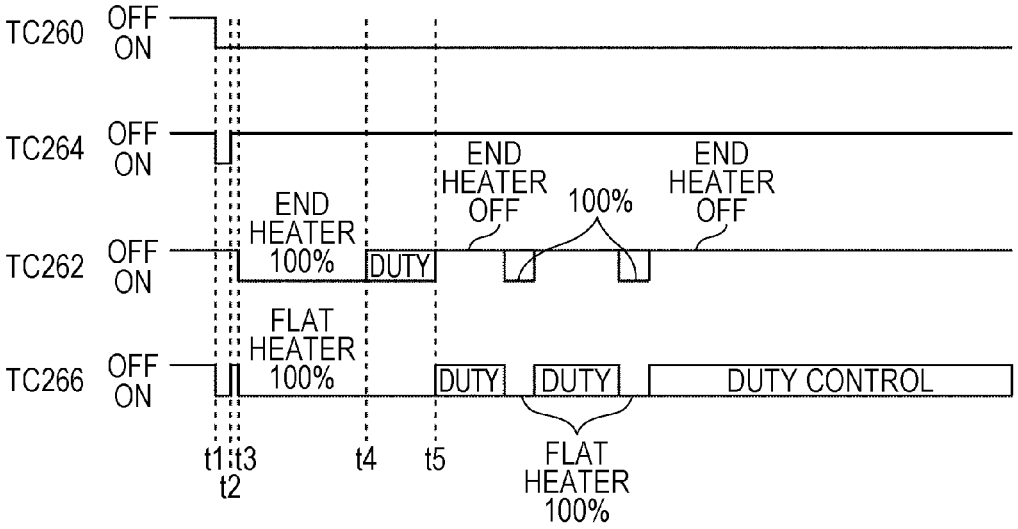
FIG. 14 is a timing chart of lighting control of triacs in a flat mode.
Figure 15:
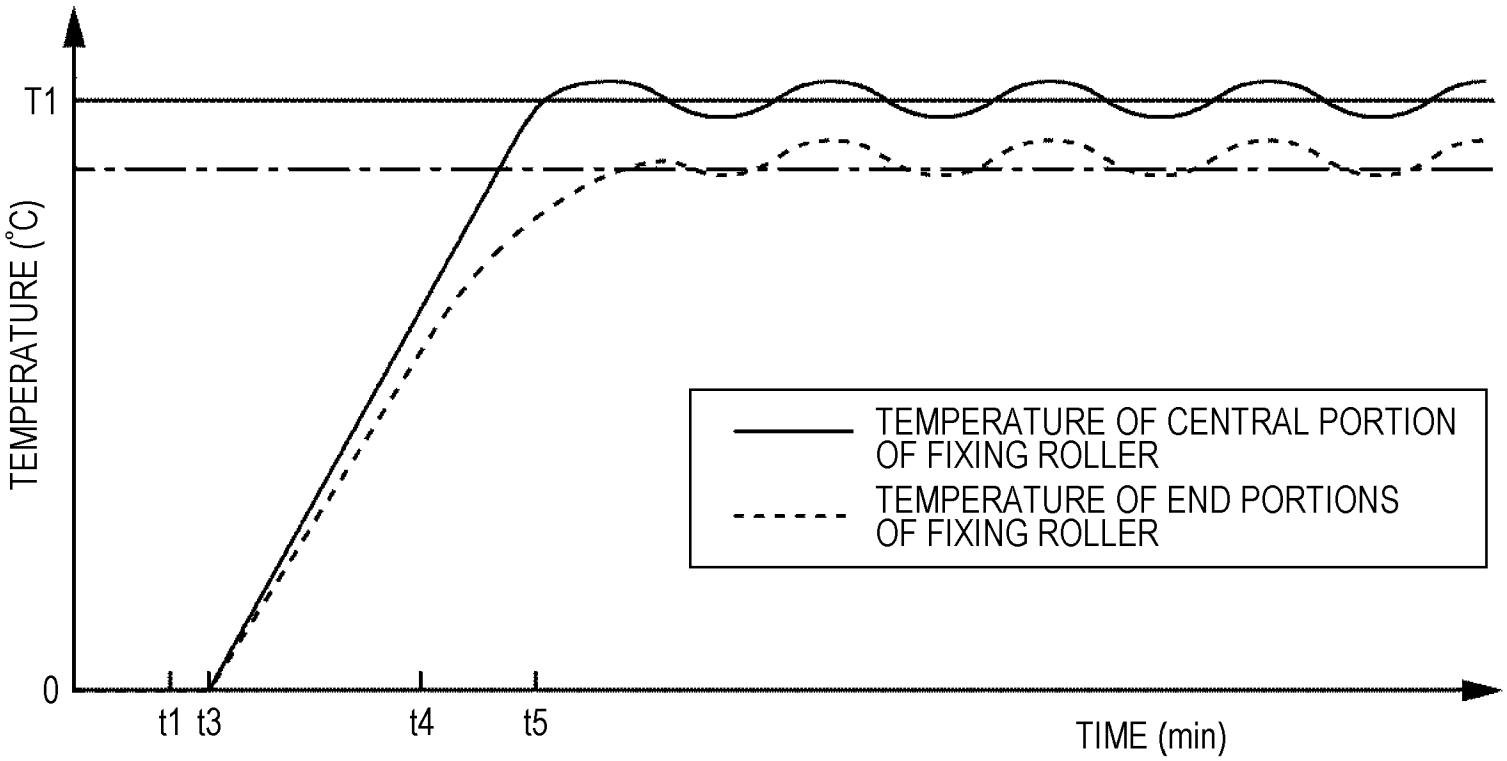
FIG. 15 is a diagram showing the relationship between the temperature of a heating roller and the time in the flat mode.
Figure 16A:
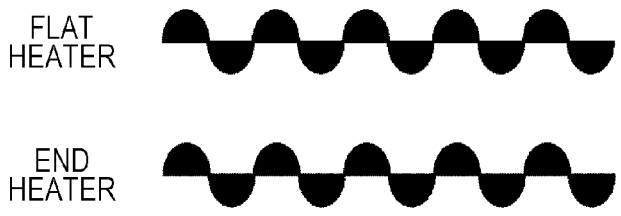
FIGS. 16A to 16C are diagrams for describing duty patterns for heaters selected in the flat mode.
Figure 16B:
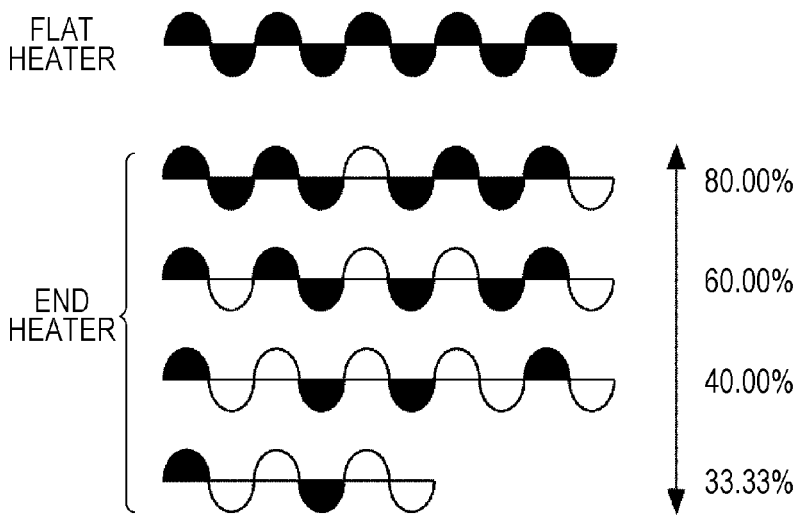
Figure 16C:
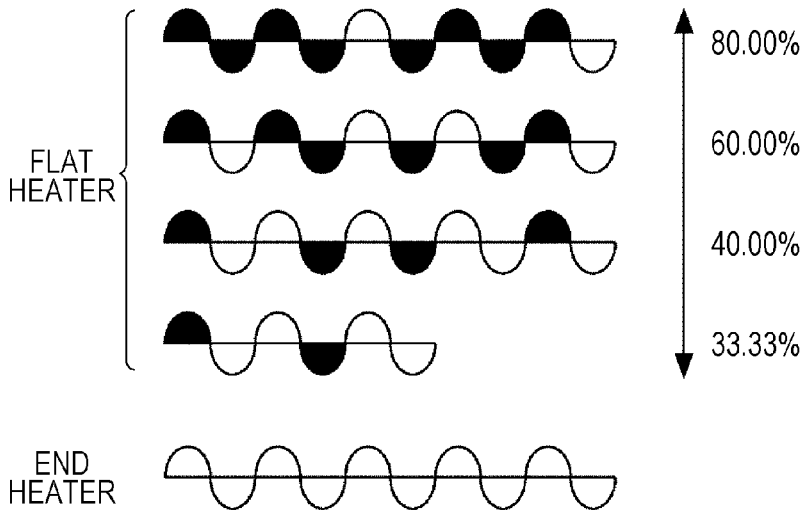

Next, descriptions will be given to as a timing chart of lighting control (on/off) of the triac 260 and others in the flat mode. FIG. 14 is a diagram showing the timing chart of lighting control of the triac 260 and others in the flat mode. FIG. 15 is a diagram showing the relationship between the temperature of the heating roller 202 and the time in the flat mode. FIGS. 16A, 16B, and 16C are diagrams for describing the duty patterns for the flat heater 220 and the end heater 230 selected in the flat mode.

As illustrated in FIG. 14, when a warm-up is started, for example, the triacs 260, 264, and 266 are turned on at time t1. Accordingly, the flat heater 220 and the end heater 230 are subjected to series lighting. At that time, the flat heater 220 and others have been just turned on and thus the temperatures of the central portion and the end portions of the heating roller 202 are an ambient temperature, as illustrated in FIG. 15.

At time t2, the triacs 264 and 266 are turned off. Accordingly, the flat heater 220 and the end heater 230 are temporarily turned off.

At time t3, the triacs 262 and 266 are turned on. Accordingly, the flat heater 220 and the end heater 230 are independently turned on (parallel lighting). Along with the parallel lighting, the temperatures of the central portion and the end portions of the heating roller 202 gradually increase as illustrate in FIG. 15. At the time of start of the parallel lighting, the flat heater 220 and the end heater 230 are turned on in the duty pattern of 100% as illustrated in FIG. 16A.

At time t4, since the flat mode is selected, the triac 262 is switched from 100% lighting to a duty control in the duty pattern at a predetermined duty ratio. Accordingly, as illustrated in FIG. 16B, the flat heater 220 is fully turned on at the duty ratio of 100%, and the end heater 230 is turned on or off in a duty pattern between 33.33% and 80%. Which of the duty patterns to be selected depends on results of calculations under PI control described later.

At time t5, when the temperature of the central portion of the heating roller 202 comes close to (or reaches) a target temperature T1, the triac 262 is turned off and the triac 266 is switched to an on/off control in a duty pattern at a predetermined duty ratio. Accordingly, as illustrated in FIG. 16C, the end heater 230 is turned off and the flat heater 220 is turned on in a duty pattern between 33.33% and 80%. At that time, as illustrated in FIG. 15, the end portions of the heating roller 202 remains at a temperature slightly lower than that of the central portion of the heating roller 202.

At time t5 and later, when the measured temperature of the central portion of the heating roller 202 falls below the target temperature T1, the triac 266 is switched to an on/off control in the duty pattern at the duty ratio of 100% and the heating roller 202 is subjected to temperature control. Similarly, when the temperature of the end portions of the heating roller 202 falls below the target temperature T1, the triac 262 is turned on, the end heater 230 is switched from the off state to the on/off control in the duty pattern at the duty ratio of 100%, and the heating roller 202 is subjected to temperature control.

[Example of a Timing Chart in the End Heat Up Mode]

Figure 17:
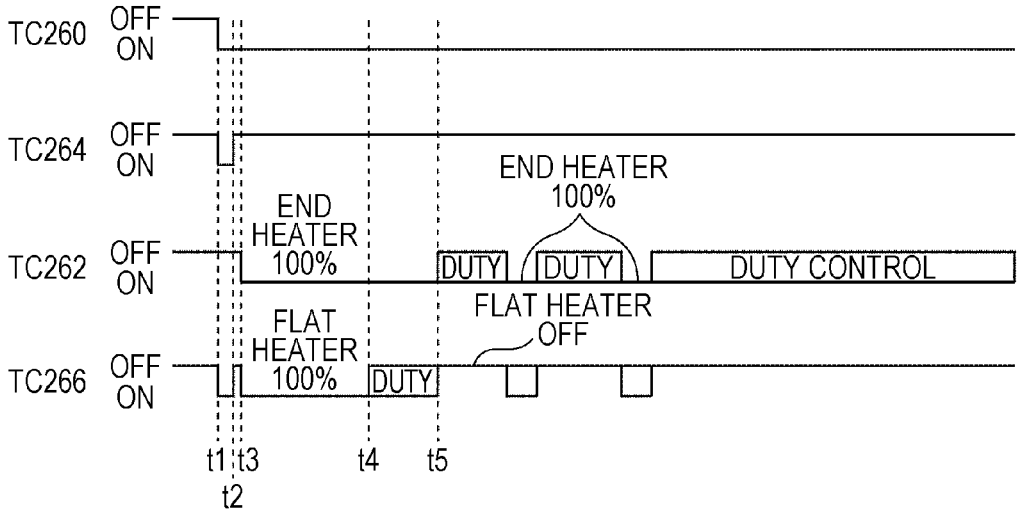
FIG. 17 is a timing chart of lighting control of triacs in an end heat up mode.
Figure 18:
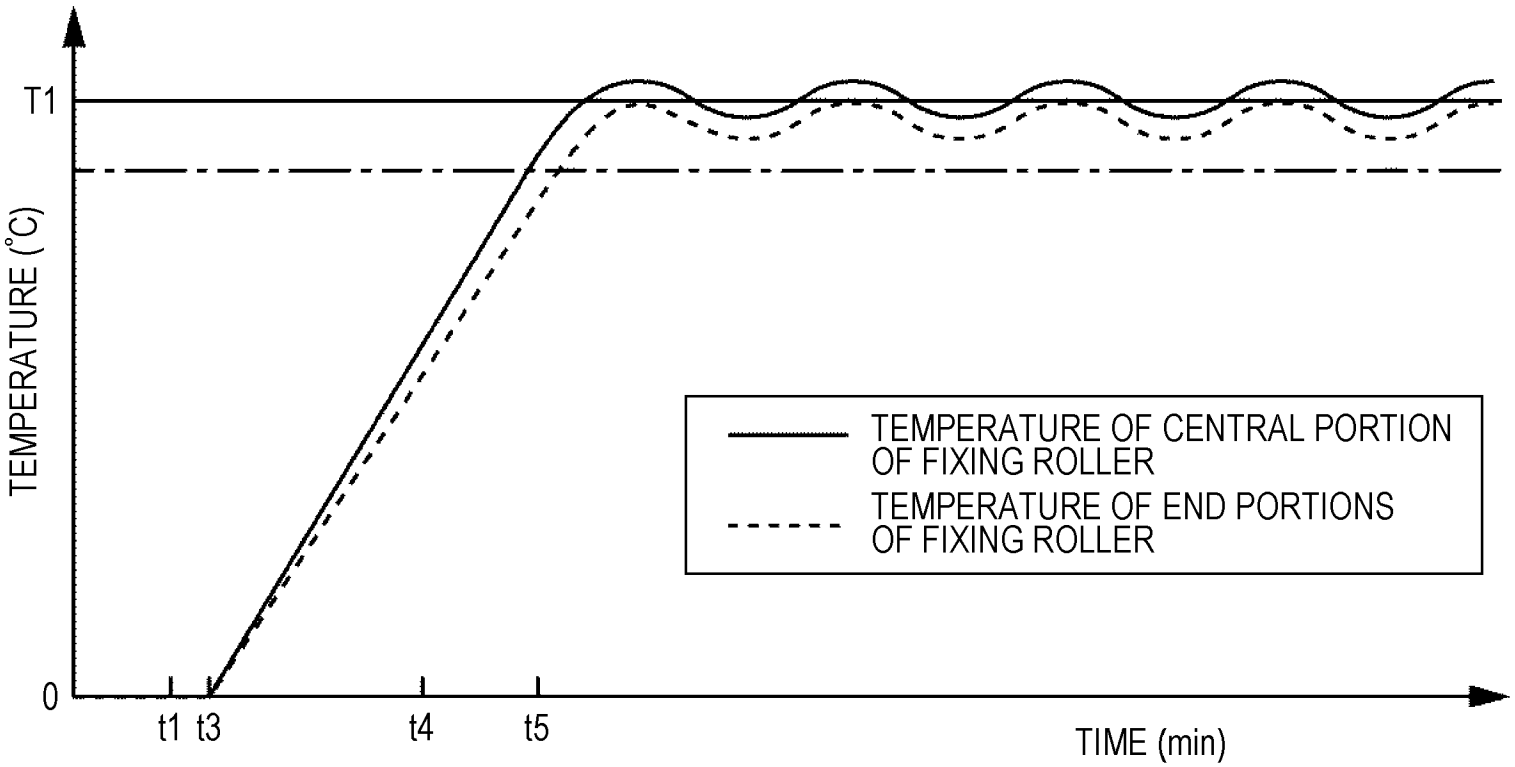
FIG. 18 is a diagram showing the relationship between the temperature of the heating roller and the time in the end heat up mode.
Figure 19A:
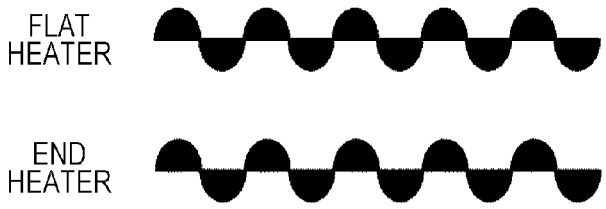
FIGS. 19A to 19C are diagrams for describing duty patterns for the heaters selected in the end heat up mode.
Figure 19B:
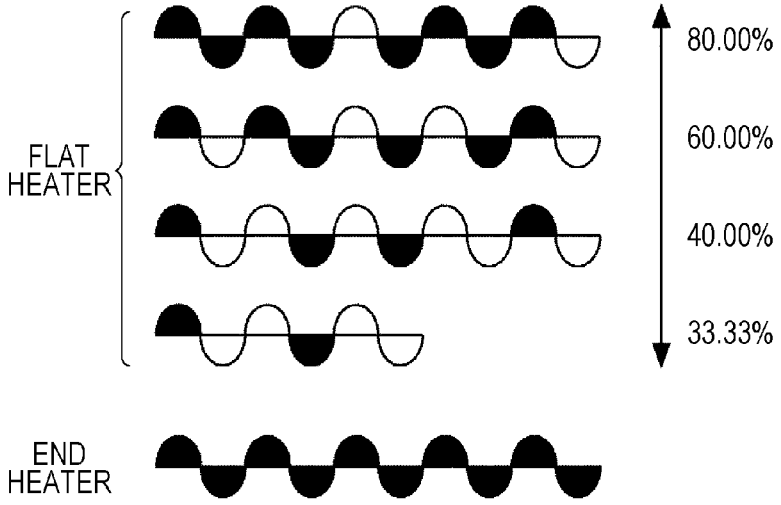
Figure 19C:
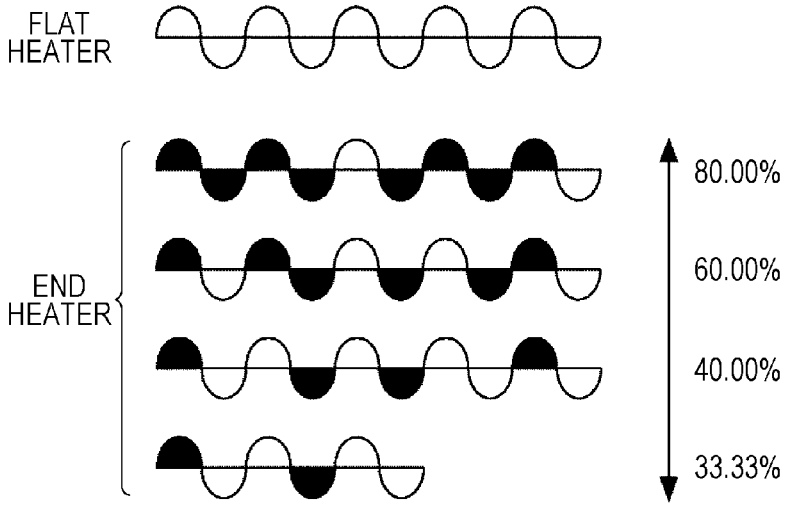

Next, descriptions will be given as to a timing chart of lighting control of the triac 260 and others in the end heat up mode. FIG. 17 is a timing chart of lighting control of the triac 260 and others in the end heat up mode. FIG. 18 is a diagram showing the relationship between the temperature of the heating roller 202 and the time in the end heat up mode. FIGS. 19A to 19C are diagrams for describing duty patterns for the flat heater 220 and the end heater 230 selected in the end heat up mode.

As illustrated in FIG. 17, when a warm-up is started, for example, the triacs 260, 264, and 266 are turned on at time t1. Accordingly, the flat heater 220 and the end heater 230 are subjected to series lighting. At that time, the flat heater 220 and others have been just turned on and thus the temperatures of the central portion and the end portions of the heating roller 202 are an ambient temperature, as illustrated in FIG. 18.

At time t2, the triacs 264 and 266 are turned off. Accordingly, the flat heater 220 and the end heater 230 are temporarily turned off.

At time t3, the triacs 262 and 266 are turned on. Accordingly, the flat heater 220 and the end heater 230 are independently turned on (parallel lighting). Along with the parallel lighting, the temperatures of the central portion and the end portions of the heating roller 202 gradually increase as illustrate in FIG. 18. At the time of start of the parallel lighting, the flat heater 220 and the end heater 230 are turned on in the duty pattern of 100% as illustrated in FIG. 19A.

At time t4, since the end heat up mode is selected, the triac 266 is switched from 100% lighting to an on/off control in a duty pattern at a predetermined duty ratio. Accordingly, as illustrated in FIG. 19B, the flat heater 220 is turned on/off in the duty pattern between 33.33% and 80%, and the end heater 230 is fully turned on at the duty ratio of 100%.

At time t5, when the temperature of the central portion of the heating roller 202 comes close to (or reaches) a target temperature T1, the triac 266 is turned off and the triac 262 is switched to an on/off control in a duty pattern at a predetermined duty ratio. Accordingly, as illustrated in FIG. 19C, the flat heater 220 is turned off and the end heater 230 is turned on in the duty pattern between 33.33% and 80%. At that time, the temperature of the end portions of the heating roller 202 rapidly increases in the end heat up mode and is kept at a temperature close to the temperature of the central portion of the heating roller 202 as illustrated in FIG. 18.

At time t5 and later, when the measured temperature of the central portion of the heating roller 202 falls below the target temperature T1, the triac 266 is switched to an on/off control in the duty pattern at the duty ratio of 100% and the heating roller 202 is subjected to temperature control. Similarly, when the temperature of the end portions of the heating roller 202 falls below the target temperature T1, the triac 262 is turned on, the flat heater 220 is switched from the off state to the on/off control in the duty pattern at the duty ratio of 100%, and the heating roller 202 is subjected to temperature control.

[Configuration Example of a Table Storing Duty Patterns in the Flat Mode]

Next, descriptions will be given as to a table TB1 storing the duty patterns for the flat heater 220 and the end heater 230 selected in the flat mode. FIG. 20 is a diagram showing an exemplary configuration of the table TB1 storing duty patterns for the flat heater 220 and the end heater 230 selected in the flat mode. The power consumption of the flat heater 220 is 1000 W, and the power consumption of the end heater 230 is 800 W.

As illustrated in FIG. 20, the table TB1 stores 15 patterns 1 to 15 as duty patterns selected in the flat mode. The patterns 1 to 15 are each associated with the duty ratio (duty pattern) for the flat heater 220, the duty ratio (duty pattern) for the end heater 230, and operation amount (PI value) calculated under PI control described later. In addition, the patterns 1 to 15 may also be stored in association with the power consumption of each of the heaters and the total power consumption of the heaters as illustrated in FIG. 20.

The patterns 1 to 7 are each configured by a combination of the duty pattern for lighting control of the flat heater 220 at the duty ratio of 100% and the duty pattern for lighting control of the end heater 230 at the duty ratio between 33.33% and 100%. The patterns 1 to 7 are selected for switching the lighting mode to the flat mode and the like, for example.

The patterns 8 to 15 are each configured with a combination of the duty pattern for lighting control of the flat heater 220 at the duty ratio between 33.33% and 100% and the duty pattern for control of the end heater 230 at the duty ratio of 0%, that is, for turning off the end heater 230. The patterns 8 to 15 are selected when the temperature of the heating roller 202 has reached the target temperature T1, for example.

[Configuration Example of a Table Storing Duty Patterns in the End Heat Up Mode]

Next, descriptions will be given as to a table TB2 storing duty patterns for the flat heater 220 and the end heater 230 selected in the end heat up mode. FIG. 21 shows an example of a configuration of the table TB2 describing the duty patterns for the flat heater 220 and the end heater 230 selected in the end heat up mode. The power consumption of the flat heater 220 is 1000 W, and the power consumption of the end heater 230 is 800 W.

As illustrate in FIG. 21, the table TB2 stores 15 patterns 1 to 15 as duty patterns selected in the end heat up mode. The patterns 1 to 15 are each associated with the duty ratio for the flat heater 220, the duty ratio for the end heater 230, and the operation amount calculated under PI control described later. In addition, the patterns 1 to 15 may be stored in association with the power consumption of each of the heaters and the total power consumption of the heaters, as illustrated in FIG. 21.

The patterns 1 to 7 are each configured with a combination of the duty pattern for lighting control of the flat heater 220 at the duty ratio between 33.33% and 100% and the duty pattern for lighting control of the end heater 230 at the duty ratio of 100%. The patterns 1 to 7 are selected for switching the lighting mode to the end heat up mode, for example.

The patterns 8 to 15 are each configured with a combination of the duty pattern for lighting control of the flat heater 220 at the duty ratio of 0%, that is, turning off the flat heater 220, and the duty pattern for control of the end heater 230 at the duty ratio between 33.33% and 100%. The patterns 8 to 15 are selected when the temperature of the heating roller 202 has reached the target temperature T1, for example.

[Example of Feedback Control]

Figure 22:
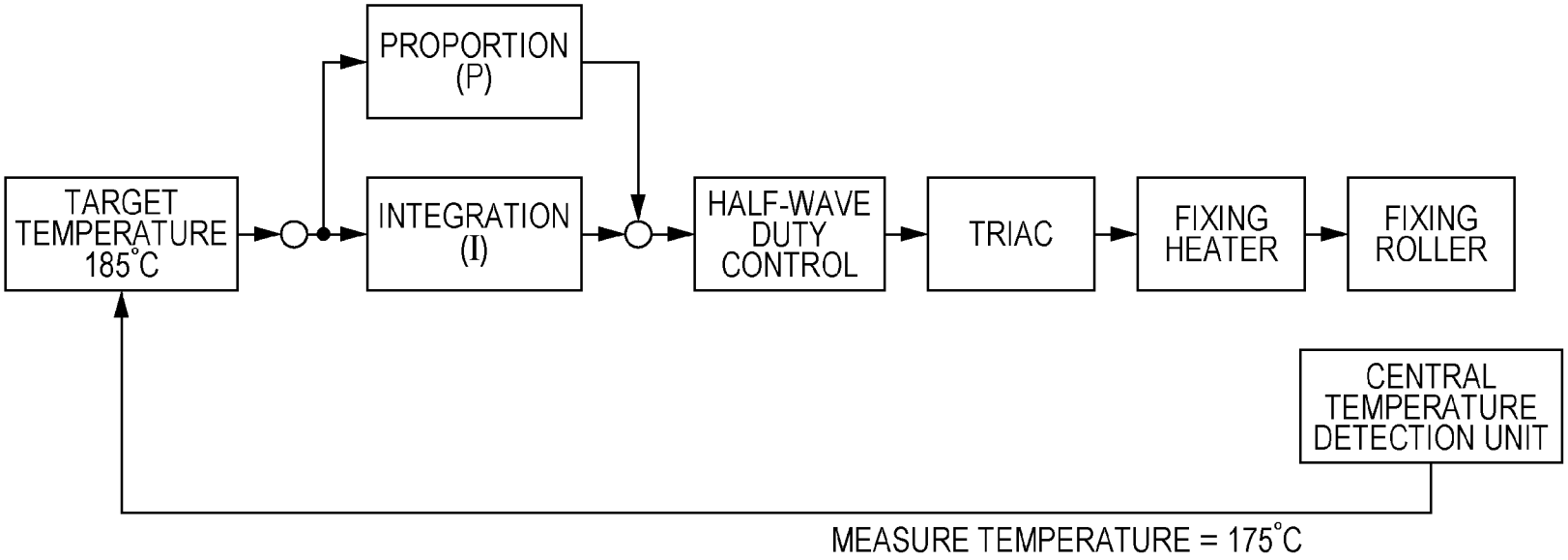
FIG. 22 is a diagram for describing a feedback control in the process of controlling the temperature of the heating roller.

Next, descriptions will be given as to an example of feedback control in the case of subjecting the heating roller 202 to temperature control. FIG. 22 is a block diagram showing an example of a sequence of the feedback control in the case of subjecting the heating roller 202 to temperature control.

As illustrated in FIG. 22, first, the target temperature of the central portion of the heating roller 202 is set. The target temperature may be set by the user operation on the operation screen of the operation display part 70, for example. The set target temperature is entered into the control unit 250 (addition part). In addition, the measured temperature of the central portion of the heating roller 202 detected by the central temperature detection unit 222 is also entered into the control unit 250.

The control unit 250 performs PI control according to the entered target temperature and measured temperature to calculate the operation amount (PI value) for use in deciding the duty patterns for the flat heater 220 and the end heater 230 under lighting control. The P control (proportion) is an operation for deciding output control according to the difference between the target temperature and the measured temperature. The I control (integration) is an operation for deciding output control according to the value of integration of the difference between the target temperature and the measured temperature.

The operation amount can be calculated by the following equation (1):

$$\text{The operation amount (Duty)} = Kp \times \text{difference} + Ki \times \text{cumulative value of differences} = Kp \times (\text{target temperature-measured temperature}) + Ki \times (\text{cumulative value of target temperature} - \text{measure temperature}) \quad (1)$$

wherein Kp represents proportional gain and Ki represents integral gain.

For example, when the target temperature is 185° C. and the measured temperature is 175° C., the operation amount is calculated by the foregoing equation (1) as follows:

$$\text{The operation amount} = 65 \times (185-175) + 2 \times (185-175+10) = 690$$

Upon activation of the flat heater 220 and others, the difference initial value (difference total) is set to 10, Kp is set to 65, and Ki is set to 10.

The control unit 250 selects the duty patterns for the flat heater 220 and the end heater 230 under lighting control according to the operation amount obtained by the calculation. Specifically, since the operation amount calculated by the equation (1) is 690, the control unit 250 selects the pattern 1 from the table TB1 shown in FIG. 20, in the flat mode, for example.

After selecting the duty patterns for the flat heater 220 and the end heater 230 under lighting control, the control unit 250 subjects the triac 262 and others to switching control according to the selected duty patterns for temperature control of the flat heater 220 and the end heater 230. Accordingly, the temperature of the central portion of the heating roller 202 can be set to the target temperature.

In the foregoing example, the PI control is used as feedback control. However, the feedback control is not limited to this but may be PID control or the like.

[Example of Operations of the Fixing Device]

Figure 23:
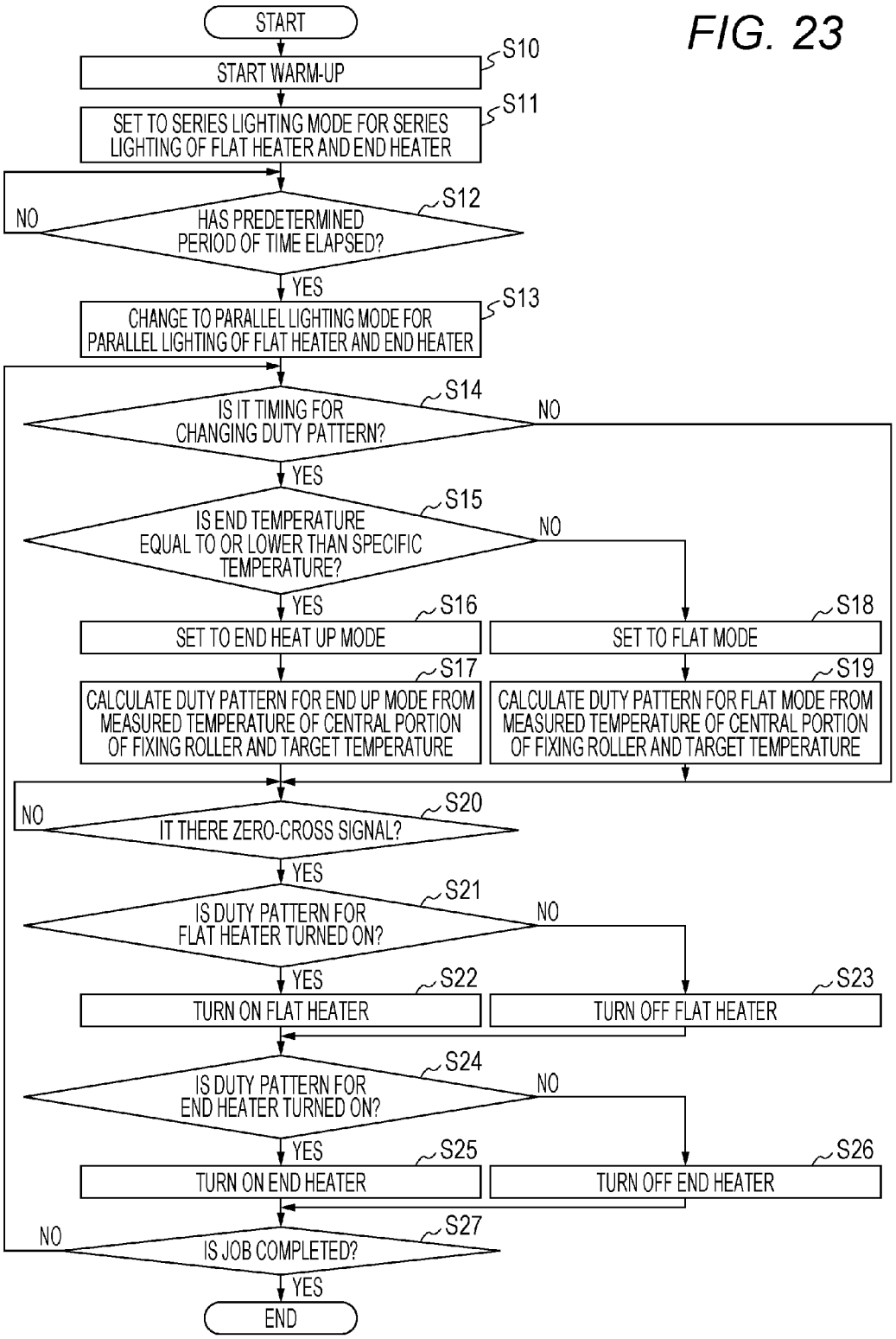
FIG. 23 is a flowchart of exemplary operations by the image forming apparatus in a fixing process.

Next, descriptions will be given as to an example of operations of the fixing device 200A in the fixing process according to the embodiment of the present invention. FIG. 23 is a flowchart of exemplary operations of the image forming apparatus 100 in the fixing process. As illustrated in FIG. 23, in step S10, when the image forming apparatus 100 is powered on, a warm-up operation is started. In step S11, the control unit 250 sets the lighting mode for the fixing device 200A to the series lighting mode. Specifically, the control unit 250 turns on the triacs 260, 264, and 266 to subject the flat heater 220 and the end heater 230 to series lighting.

After subjecting the flat heater 220 and the end heater 230 to series lighting, in step S12, the control unit 250 determines whether a predetermined period of time has elapsed. When determining that a predetermined period of time has elapsed, the control unit 250 moves the process to step S13. When not determining that the predetermined period of time has elapsed, the control unit 250 continues time count until the predetermined period of time has elapsed.

After lapse of the predetermined period of time, in step S13, the control unit 250 changes the lighting mode for the fixing device 200A from the series lighting mode to the parallel lighting mode. Specifically, the control unit 250 turns on the triacs 260, 262, and 266 and turns off the triac 264 to subject the flat heater 220 and the end heater 230 to parallel lighting.

In step S14, the control unit 250 determines whether it is the timing for changing the selected duty patterns for the flat heater 220 and the end heater 230. For example, the control unit 250 determines whether it is the timing for changing the duty pattern depending on whether one prescribed cycle of the selected duty pattern has been completed. When determining that it is the timing for changing the duty pattern, the control unit 250 moves the process to step S15. When not determining that it is the timing for changing the duty pattern, the control unit 250 moves the process to step S20.

In step S15, the control unit 250 acquires the measured temperature of the end portions of the heating roller 202 measured by the end temperature detection unit 232, and determines whether the acquired measured temperature of the end portions of the heating roller 202 is equal to or less than a preset reference temperature. The reference temperature refers to temperature information for use in determining whether the temperature of the end portions of the heating roller 202 is not lowered to a specific temperature or lower. The reference temperature can be set to an arbitrary value on the operation screen of the operation display part 70, for example. When determining that the measured temperature of the end portions of the heating roller 202 is equal to or lower than the reference temperature, the control unit 250 moves the process to step S16. When determining that the measured temperature of the end portions of the heating roller 202 has exceeded the reference temperature, the control unit 250 moves the process to step S18.

When the measured temperature of the end portions of the heating roller 202 is equal to or lower than the reference temperature, the control unit 250 sets the lighting mode for the fixing device 200A to the end heat up mode in step S16. In the end heat up mode, the control unit 250 performs temperature control to preferentially increase the temperature of the end portions of the heating roller 202 in such a manner that the end heater 230 is set as a main heater with the largest amount of heat supply to the end portions and the flat heater 220 is set as a sub heater with the second largest supply to the end portions.

In step S17, the control unit 250 selects the duty pattern in the end heat up mode according to the results of comparison between the measured temperature of the central portion of the heating roller 202 measured by the central temperature detection unit 222 and the preset target temperature of the same. The control unit 250 calculates the operation amount from the results of calculation in the PI control (refer to FIG. 22), and selects the duty pattern corresponding to the calculated operation amount from the table TB2 shown in FIG. 21.

For example, the control unit 250 subjects the end heater 230 as the main heater to lighting control in the duty pattern at the duty ratio of 100%, and subjects the flat heater 220 as the sub heater to lighting control in the duty pattern at the duty ratio between 33.33% and 80%. When the temperature of the central portion of the heating roller 202 comes close to the target temperature, the control unit 250 subjects the end heater 230 as the main heater to lighting control in the duty pattern at the duty ratio between 33.33% and 80%, and turns off the flat heater 220 as the sub heater.

Meanwhile, when the measured temperature of the end portions of the heating roller 202 has exceeded the reference temperature, the control unit 250 sets the lighting mode for the fixing device 200A to the flat mode in step S18. In the flat mode, the control unit 250 performs temperature control to keep uniform the temperature of the heating roller 202 in such a manner that the flat heater 220 is set as a main heater with the least amount of heat supply to the end portions and the end heater 230 is set as a sub heater with the second least amount of heat supply to the end portions.

In step S19, the control unit 250 selects the duty pattern in the flat mode according to the result of comparison between the measured temperature of the central portion of the heating roller 202 measured by the central temperature detection unit 222 and the preset target temperature of the same. The control unit 250 calculates the operation amount from the result of calculation in the PI control (refer to FIG. 22), and selects the duty pattern corresponding to the calculated operation amount from the table TB1 illustrated in FIG. 20.

For example, the control unit 250 subjects the flat heater 220 as the main heater to lighting control in the duty pattern at the duty ratio of 100%, and subjects the end heater 230 as the sub heater to lighting control in the duty pattern at the duty ratio between 33.33% and 80%. When the temperature of the central portion of the heating roller 202 comes close to the target temperature, the control unit 250 also subjects the flat heater 220 as the main heater to lighting control in the duty pattern at the duty ratio between 33.33% and 80%, and turns off the end heater 230 as the sub heater.

In step S20, the control unit 250 determines whether there is a zero-cross signal. When determining that there is a zero-cross signal, the control unit 250 moves the process to step S21. When not determining that there is a zero-cross signal, the control unit 250 continues to monitor for the presence or the absence of a zero-cross signal.

In step S21, the control unit 250 determines whether the selected duty pattern for the flat heater 220 is a lighting pattern (on). When determining that the duty pattern for the flat heater 220 is a lighting pattern, the control unit 250 moves the process to step S22. When not determining that the duty pattern for the flat heater 220 is a lighting pattern, the control unit 250 moves the process to step S23.

When the duty pattern for the flat heater 220 is a lighting pattern, the control unit 250 turns on the triacs 260 and 266 to turn on the flat heater 220 in step S22. Meanwhile, when the duty pattern for the flat heater 220 is not a lighting pattern, the control unit 250 turns off the triacs 260 and 266 to turn off the flat heater 220 in step S23.

In step S24, the control unit 250 determines whether the selected duty pattern for the end heater 230 is a lighting pattern. When determining that the duty pattern for the end heater 230 is a lighting pattern, the control unit 250 moves the process to step S25. When not determining that the duty pattern for the end heater 230 is a lighting pattern, the control unit 250 moves the process to step S26.

When the duty pattern for the end heater 230 is a lighting pattern, the control unit 250 turns on the triacs 260 and 262 to turn on the end heater 230 in step S25, for example. Meanwhile, when the duty pattern for the end heater 230 is not a lighting pattern, the control unit 250 turns off the triacs 260 and 262 to turn off the end heater 230 in step S26, for example.

In step S27, the control unit 250 determines whether the job has been completed. When determining that the job has been completed, the control unit 250 terminates the series of operations in the image forming process including the lighting control of the fixing device 200A described above. Meanwhile, when not determining that the job has been completed, the control unit 250 returns the process to step S14 to repeat the lighting control of the fixing device 200A described above.

As described above, according to the first embodiment, the end heat up mode or the flat mode is set depending on the temperature of the end portions of the heating roller 202, which makes it possible to prevent reduction in the temperature of the end portions of the heating roller 202 even if the thinned heating roller 202 is used. Accordingly, it is possible to keep uniform the temperature of the heating roller 202 and reduce temperature ripples on the heating roller 202. In the end heat up mode during a warming-up or the like, it is preferable to make temperature adjustments while the heating roller 202 and others are rotated. This makes it possible to increase the temperatures of the central portion and the end portions of the heating roller 202 in a uniform manner, whereby to enable temperature control of the fixing device 200A at a higher accuracy.

In addition, in the first embodiment, one of the heaters is subjected to lighting control at the duty ratio of 100%, the other heater is subjected to lighting control at a predetermined duty ratio, and as illustrated in FIGS. 7 to 13, the optimum duty patterns are used to subject the flat heater 220 and others to lighting control. This makes it possible to suppress the occurrence of flickers at a lighting device and the like. In addition, in the end heat up mode and the flat mode, only one of the heaters is subjected to lighting control at a predetermined duty ratio, which prevents control by the control unit 250 from being complicated.

Second Embodiment

A second embodiment is different from the fixing device 200A of the first embodiment in that a fixing device 200B is composed of three heaters different in heat distribution. The other components and operations of the image forming apparatus 100 in the second embodiment are the same as those in the first embodiment. Thus, the same components in the second embodiment as those in the first embodiment will be given the same reference numerals as those in the first embodiment, and thus detailed descriptions of the fixing device 200B and others will be omitted.

[Configuration Example of the Fixing Device]

Figure 24:
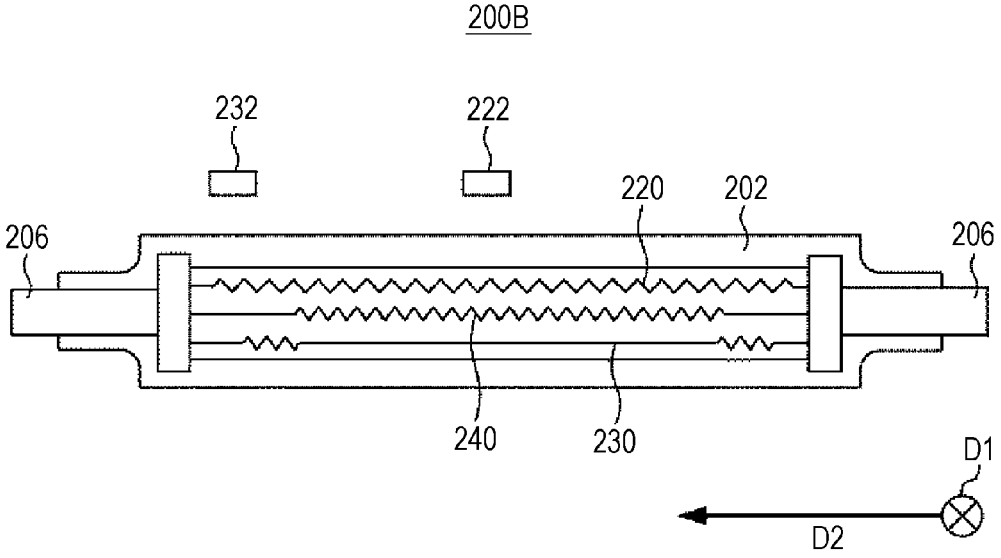
FIG. 24 is a cross-sectional view showing an exemplary configuration of a fixing device according to a second embodiment.
Figure 25A:
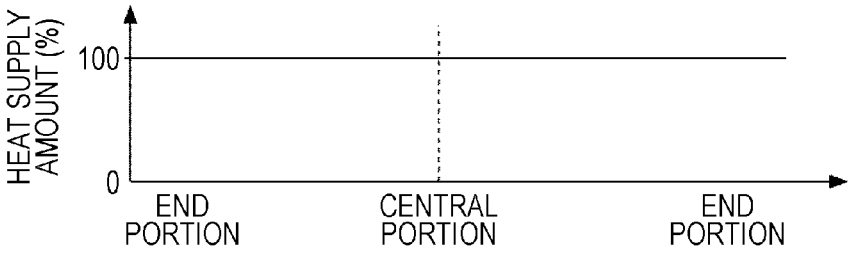
FIGS. 25A to 25C are diagrams showing distributions of heat supply amounts of heaters constituting a fixing device.
Figure 25B:
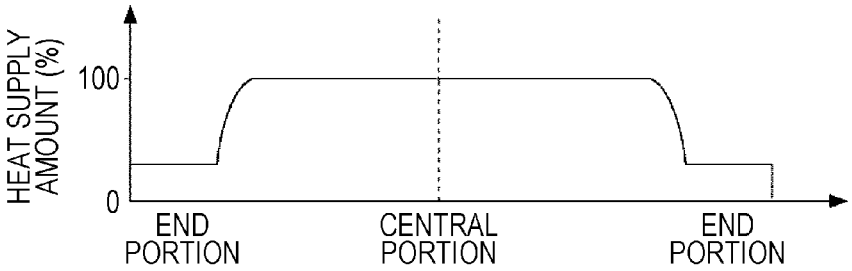
Figure 25C:
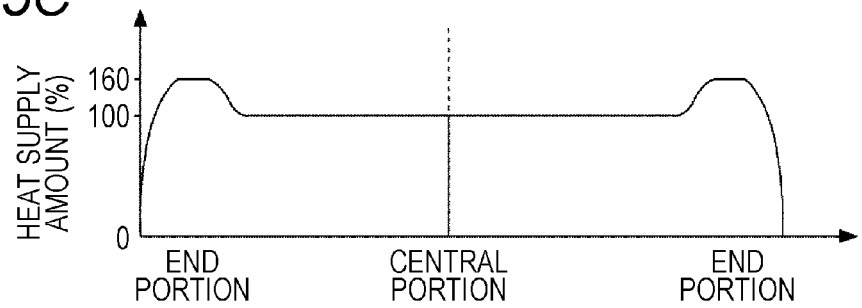

First, a schematic configuration example of the fixing device 200B will be described. FIG. 24 is a cross-sectional view showing an exemplary configuration of the fixing device 200B of the second embodiment as seen from the paper conveying direction D1 side. FIG. 25A is a diagram showing distribution of heat supply amount of the flat heater 220, FIG. 25B is a diagram showing distribution of heat supply amount of a central heater 240, and FIG. 25C is a diagram showing distribution of heat supply amount of the end heater 230.

As illustrated in FIG. 24, the fixing device 200B includes the heating roller 202, the support members 206, the flat heater 220, the central heater 240, the end heater 230, the central temperature detection unit 222, and the end temperature detection unit 232. The flat heater 220, the central heater 240, and the end heater 230 are provided within the heating roller 202.

The central heater 240 is arranged along the axial direction of the heating roller 202 and is almost identical in length to the heating roller 202 in the axial direction. The central heater 240 is configured in such a manner that the distribution of amount of heat supply to an approximately central portion of the heating roller 202 along the longitudinal side (areas except for the end portions) is the largest. Specifically, as illustrated in FIG. 25B, the amount of heat supply to the central portion of the heating roller 202 along the longitudinal side is 100%, and the amount of heat supply to the end portions of the heating roller 202 along the longitudinal side is 30%.

[Example of a Circuit Configuration of the Fixing Device]

Figure 26:
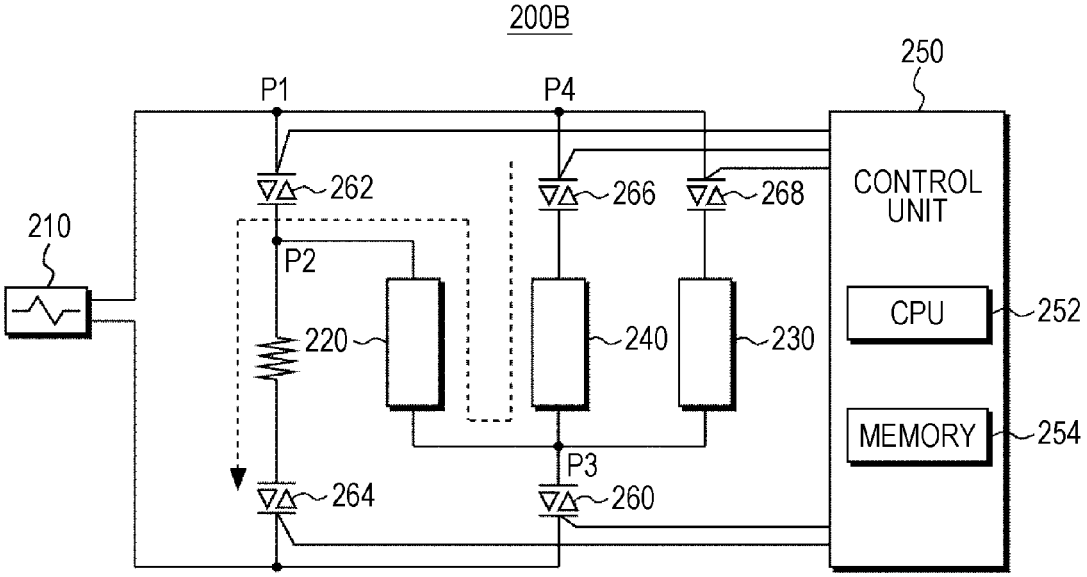
FIG. 26 is a block diagram showing an exemplary circuit configuration of the fixing device.

Next, a circuit configuration of the fixing device 200B will be described. FIG. 26 illustrates an example of the circuit configuration of the fixing device 200B. As illustrated in FIG. 26, the fixing device 200B of the embodiment is composed of a series-parallel lighting circuit that subjects the flat heater 220, the end heater 230, and the central heater 240 to series lighting, parallel lighting, or single lighting.

The fixing device 200B includes the alternating-current power source unit 210, the flat heater 220, the end heater 230, the central heater 240, the control unit 250, and the triacs 260, 262, 264, 266, and 268.

The triacs 266 and 268 are connected in parallel to a connection point P4 connected to the connection point P1. The central heater 240 is connected at one end to the triac 266 and connected at the other end to the connection point P3. The central heater 240 is turned on or off according to a half-wave duty pattern supplied from the control unit 250 via the triac 266 and others. The end heater 230 is connected at one end to the triac 268 and connected at the other end to the connection point P3. The end heater 230 is turned on and off according to a half-wave duty pattern supplied from the control unit 250 via the triac 268 and the like.

[Example of Operations of the Fixing Device]

Figure 27A:
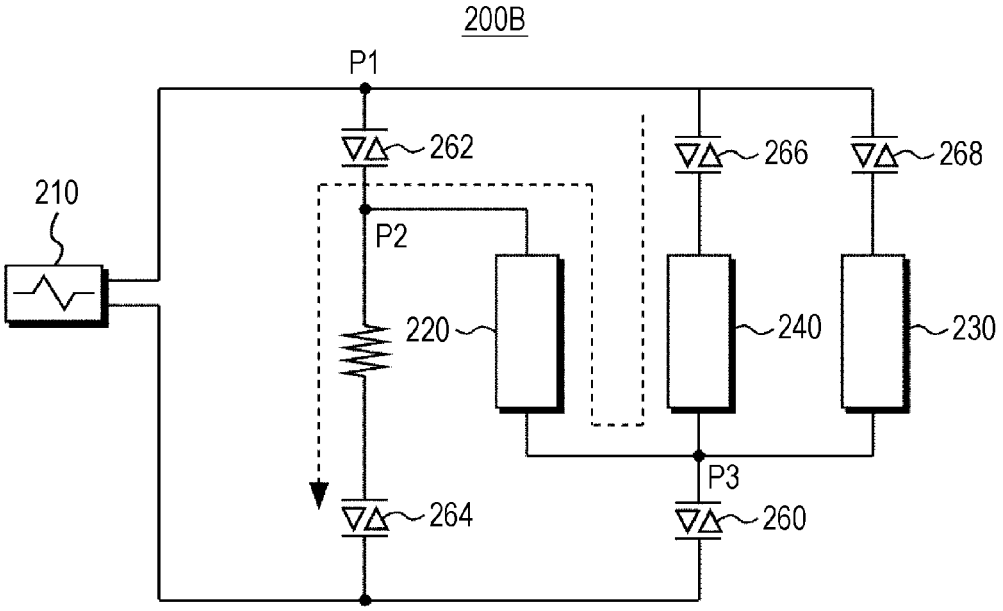
FIGS. 27A and 27B are diagrams for describing lighting control at the fixing device in the flat mode.
Figure 27B:
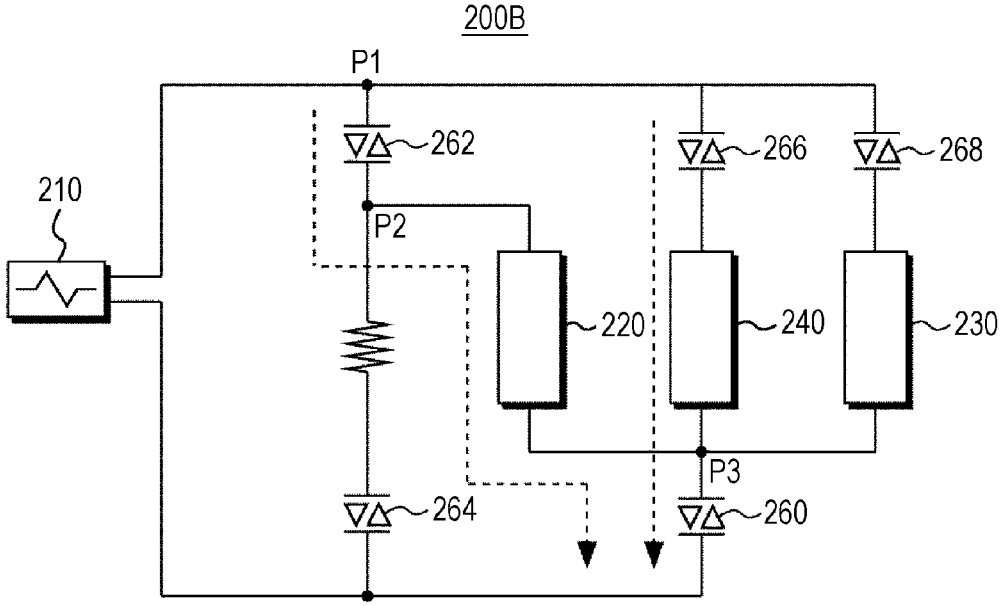

FIGS. 27A and 27B are diagrams for describing an example of operations of the fixing device 200B in the flat mode. When a warming-up or the like is started, the control unit 250 turns on the triacs 264 and 266. Accordingly, the flat heater 220 and the central heater 240 are subjected to series lighting as illustrated in FIG. 27A.

After a predetermined period of time has elapsed since the series lighting, the control unit 250 turns on the triacs 260, 262, and 266. Accordingly, the flat heater 220 and the central heater 240 are switched from series lighting to parallel lighting as illustrated in FIG. 27B. Since the lighting mode is the flat mode at that time, the control unit 250 sets the central heater 240 with the least amount of heat supply to the end portions as a main heater and sets the flat heater 220 with the second least amount of heat supply to the end portions as a sub heater.

The control unit 250 subjects the central heater 240 as the main heater to lighting control at the duty ratio of 100%, and subjects the flat heater 220 as the sub heater to lighting control in a duty pattern at a duty ratio between 33.33% and 80%. The control unit 250 also subjects the central heater 240 as the main heater to lighting control in a duty pattern at a duty ratio between 33.33% and 80% and turns off the flat heater 220 as the sub heater.

Figure 28A:
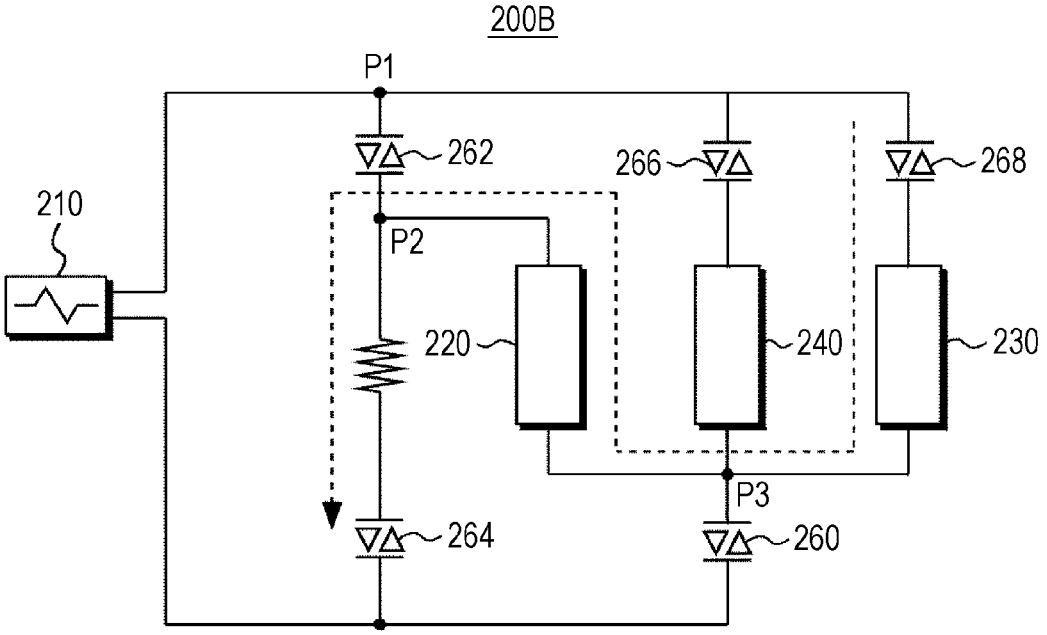
FIGS. 28A and 28B are diagrams for describing lighting control at the fixing device in the end mode.
Figure 28B:
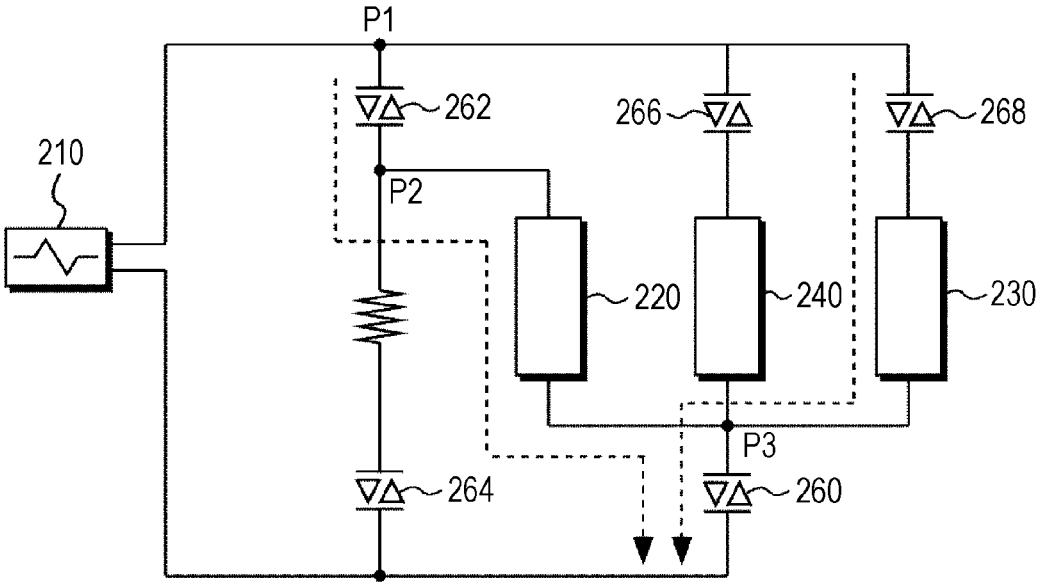

FIGS. 28A and 28B are diagram for describing an example of operations of the fixing device 200B in the end heat up mode. When a warming-up or the like is started, for example, the control unit 250 turns on the triacs 264 and 268. Accordingly, the flat heater 220 and the end heater 230 are subjected to series lighting as illustrated in FIG. 28A.

After a predetermined period of time has elapsed since the series lighting, the control unit 250 turns on the triacs 260, 262, and 268. Accordingly, as illustrated in FIG. 28B, the flat heater 220 and the central heater 240 are switched from series lighting to parallel lighting. Since the lighting mode is the end heat up mode at that time, the end heater 230 with the largest amount of heat supply to the end portions is set as a main heater, and the flat heater 220 with the second largest amount of heat supply to the end portions is set as a sub heater.

The control unit 250 subjects the end heater 230 as the main heater to lighting control at a duty ratio of 100%, and subjects the flat heater 220 as the sub heater to lighting control in a duty pattern at a duty ratio between 33.33% and 80%. The control unit 250 also subjects the end heater 230 as the main heater to lighting control in a duty pattern at a duty ratio between 33.33% and 80% and turns off the flat heater 220 as the sub heater.

As described above, according to the second embodiment, it is possible to produce the same advantages as those of the first embodiment. In addition, according to the second embodiment, the central heater 240 is added to allow finer temperature adjustments with the three heaters.

Third Embodiment

A third embodiment is different from the first and second embodiments in that the temperature of the end portions of the heating roller 202 is not detected by the end temperature detection unit 232 but is estimated from the off times of the heaters to decide lighting control of the heaters. A fixing device 200C in the third embodiment is configured in the same manner as the first embodiment except for the absence of the end temperature detection unit 232, and thus the same components in the third embodiment as those in the first embodiment will be given the same reference numerals as those in the first embodiment, and thus detailed descriptions thereof will be omitted.

Figure 29:
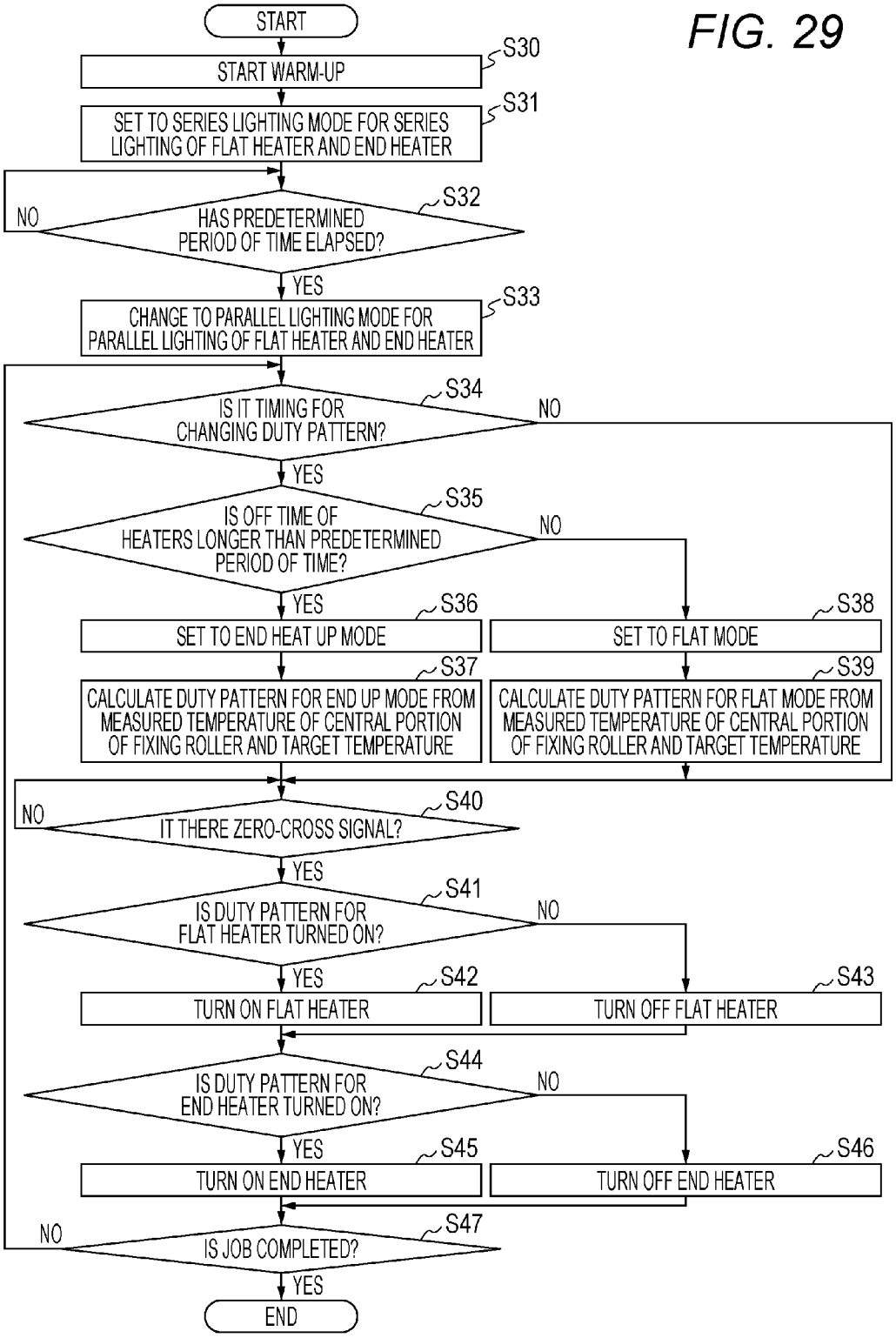
FIG. 29 is a flowchart of exemplary operations by an image forming apparatus in a fixing process according to a third embodiment.

FIG. 29 is a flowchart of exemplary operations by the fixing device 200C according to the third embodiment of the present invention. The lighting control of the flat heater 220 and others except for step S35 is the same as that of the flat heater 220 and others in steps S10 to S14 and S16 to S27 in the first embodiment, and thus detailed descriptions thereof will be omitted.

In step S35, the control unit 250 determines whether a predetermined period of off time of the flat heater 220 and the end heater 230 (hereinafter, referred to as the flat heater 220 and others) has elapsed. The flat heater 220 and others are turned off when the operation mode is switched to a low-power mode (energy-saving mode) or the like, for example. The control unit 250 counts and calculates the off time of the flat heater 220 and others and compares the calculated off time with a preset reference off time.

When the off time of the flat heater 220 and others is longer than the reference off time, the control unit 250 estimates that a predetermined period of off time of the flat heater 220 and others has continuously elapsed and the temperature of the end portions of the heating roller 202 is lowered, and then moves the process to step S36. Meanwhile, when the off time of the flat heater 220 and others is equal to or shorter than the reference off time, the control unit 250 estimates that a predetermined period of off time of the flat heater 220 and others has elapsed and the temperature of the end portions of the heating roller 202 is not lowered, and then moves the process to step S38.

When the off time of the flat heater 220 and others is longer than the reference off time, the control unit 250 sets the lighting mode of the fixing device 200C to the end heat up mode in step S36. In the end heat up mode, the control unit 250 subjects the flat heater 220 to lighting control in a duty pattern at a duty ratio between 33.33% and 80% or turns off the flat heater 220, and subjects the end heater 230 to lighting control in a duty pattern at a duty ratio between 33.33% and 100%.

Meanwhile, when the off time of the flat heater 220 and others is equal to or less than the reference off time, the control unit 250 sets the lighting mode of the fixing device 200C to the flat mode in step S38. In the flat mode, the control unit 250 subjects the flat heater 220 to lighting control in a duty pattern at a duty ratio between 33.33% and 100% and subjects the end heater 230 to lighting control in a duty pattern at a duty ratio between 33.33% and 80% or turns off the end heater 230.

As described above, according to the third embodiment, even when the end temperature detection unit 232 is not provided, the temperature of the end portions of the heating roller 202 is estimated from the off time of the flat heater 220 and others, thereby allowing correct and high-accuracy temperature control. In addition, since the fixing device 200C does not need the end temperature detection unit 232, the fixing device 200C can be provided in a simpler configuration and at lower costs.

Fourth Embodiment

A fourth embodiment is different from the first and second embodiments in that the temperature of the end portions of the heating roller 202 is not detected by the end temperature detection unit 232 but is estimated from the off time of the heaters to decide lighting control of the heaters. A fixing device 200D in the fourth embodiment is configured in the same manner as the first embodiment except for the absence of the end temperature detection unit 232, and thus the same components in the fourth embodiments as those in the first embodiment will be given the same reference numerals as those in the first embodiment, and thus detailed descriptions thereof will be omitted.

Figure 30:
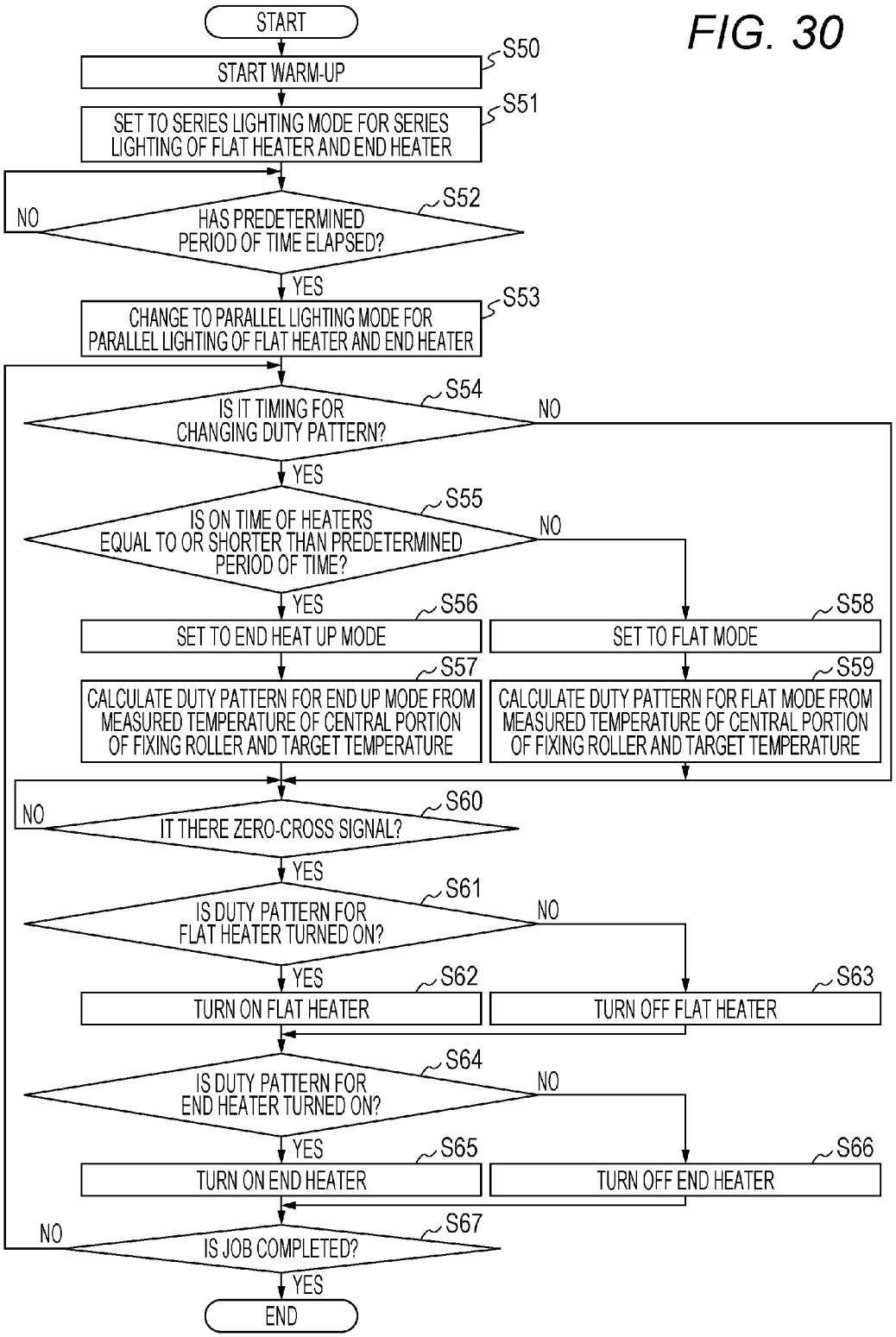
FIG. 30 is a flowchart of exemplary operations by an image forming apparatus in a fixing process according to a fourth embodiment.

FIG. 30 is a flowchart of exemplary operations of the fixing device 200D in the fourth embodiment of the present invention. The lighting control of the flat heater 220 and others except for step S55 is the same as that of the flat heater 220 and others in steps S10 to S14 and S16 to S27 in the first embodiment, and thus detailed descriptions thereof will be omitted.

In step S55, the control unit 250 determines whether on time of the flat heater 220 and others is equal to or shorter than a predetermined period of time. The flat heater 220 and others are turned on in the flat mode or the end heat up mode, for example. The control unit 250 counts and calculates the on time of the flat heater 220 and others in the flat mode or the end heat up mode, and compares the calculated on time with a preset reference on time.

When the on time of the flat heater 220 and others is equal to or shorter than the reference on time, the control unit 250 estimates that the temperature of the end portions of the heating roller 202 is lowered, and then moves the process to step S56. Meanwhile, when the on time of the flat heater 220 and others is longer than the reference off time, the control unit 250 estimates that the temperature of the end portions of the heating roller 202 is not lowered, and then moves the process to step S58.

When the on time of the flat heater 220 and others is shorter than the reference on time, the control unit 250 sets the lighting mode of the fixing device 200D to the end heat up mode in step S56. In the end heat up mode, the control unit 250 subjects the flat heater 220 to lighting control in a duty pattern at a duty ratio between 33.33% and 80% or turns off the flat heater 220, and subjects the end heater 230 to lighting control in a duty pattern at a duty ratio between 33.33% and 100%.

Meanwhile, when the on time of the flat heater 220 and others is longer than the reference on time, the control unit 250 sets the lighting mode of the fixing device 200D to the flat mode in step S58. In the flat mode, the control unit 250 subjects the flat heater 220 to lighting control in a duty pattern at a duty ratio between 33.33% and 100% and subjects the end heater 230 to lighting control in a duty pattern at a duty ratio between 33.33% and 80% or turns off the end heater 230.

As described above, according to the fourth embodiment, even when the end temperature detection unit 232 is not provided, the temperature of the end portions of the heating roller 202 is estimated from the on time of the flat heater 220 and others, thereby allowing correct and high-accuracy temperature control. In addition, since the fixing device 200D does not need the end temperature detection unit 232, the fixing device 200D can be provided in a simpler configuration and at lower costs. In this example, during a printing job or a warming-up, the flat mode and the end heat up mode can be alternated in a period of one minute.

Fifth Embodiment

A fifth embodiment is different from the first to fourth embodiments in that lighting control of the heaters is decided not according to the detection by the end temperature detection unit 232 but according to the size of the paper P. A fixing device 200E in the fifth embodiment is configured in the same manner as the first embodiment except for the absence of the end temperature detection unit 232, and thus the same components in the fifth embodiment as those in the first embodiment will be given the same reference numerals as those in the first embodiment, and thus detailed descriptions thereof will be omitted.

Figure 31:
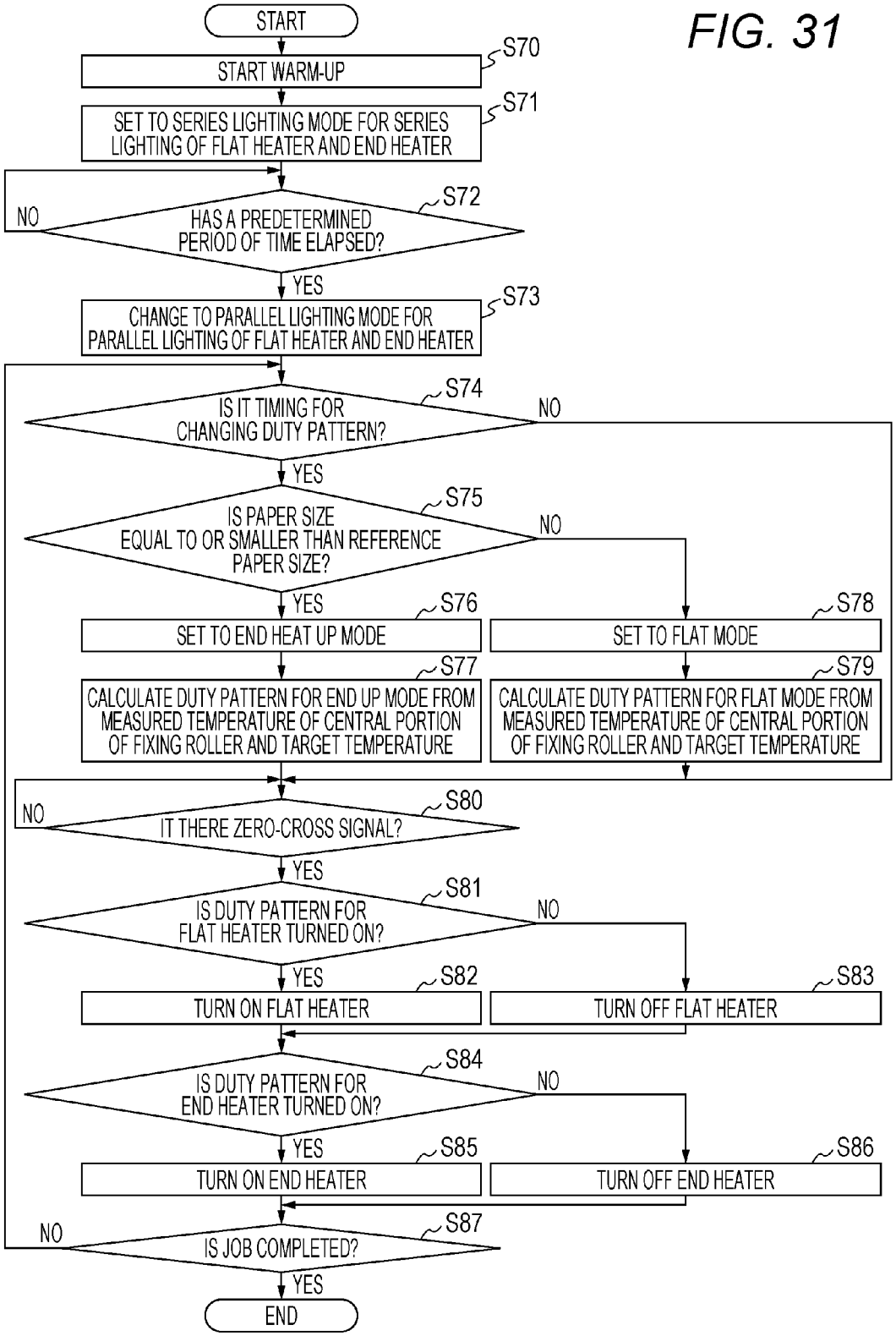
FIG. 31 is a flowchart of exemplary operations by an image forming apparatus in a fixing process according to a fifth embodiment.

FIG. 31 is a flowchart of exemplary operations of the fixing device 200D in the fifth embodiment of the present invention. The lighting control of the flat heater 220 and others except for step S75 is the same as that of the flat heater 220 and others in steps S10 to S14 and S16 to S27 in the first embodiment, and thus detailed descriptions thereof will be omitted.

In step S75, the control unit 250 determines whether the size of the paper P on which an image is to be formed is equal to or smaller than a preset reference paper size. In this example, the reference paper size is a small size of A4S, for example. The size information of the paper P may be acquired from job information on the operation display part 70 or the like or acquired through detection by a sensor or the like. When determining that the size of the paper P is equal to or smaller than the preset reference paper size, the control unit 250 moves the process to step S76. When determining that the size of the paper P is larger than the preset reference paper size, the control unit 250 moves the process to step S78.

When the size of the paper P is equal to or smaller than the reference paper size, the control unit 250 sets the operation mode to the flat mode in step S76. This is because, in the case of the small-sized paper P, the end portions of the heating roller 202 are non-paper feed areas and thus there is less need to increase the temperature of the end portions of the heating roller 202. In the flat mode, the control unit 250 subjects the flat heater 220 to lighting control in a duty pattern at a duty ratio between 33.33% and 100%, and subjects the end heater 230 to lighting control in a duty pattern at a duty ratio between 33.33% and 80% or turns off the end heater 230.

Meanwhile, when the size of the paper P is larger than the reference paper size, the control unit 250 sets the operation mode to the end heat up mode in step S78. In the end heat up mode, the control unit 250 subjects the flat heater 220 to lighting control in a duty pattern at a duty ratio between 33.33% and 80% or turns off the flat heater 220, and subjects the end heater 230 to lighting control in a duty pattern at a duty ratio between 33.33% and 100%.

As described above, according to the fifth embodiment, it is possible to produce the same advantages as those in the first embodiment. In addition, according to the fifth embodiment, it is possible to select the optimum lighting mode according to the size of the paper P. This allows energy saving in the fixing device 200D in a more effective manner.

Sixth Embodiment

A sixth embodiment is different from the first to fifth embodiments in that the temperature of the end portions of the heating roller 202 is not detected by the end temperature detection unit 232 but is estimated from the temperature of the central portion of the same to decide lighting control of the heaters. A fixing device 200F in the sixth embodiment is configured in the same manner as the image forming apparatus 100 described in the first embodiment except for the absence of the end temperature detection unit 232, and thus the same components in the six embodiment as those in the first embodiment will be given the same reference numerals as those in the first embodiment, and thus detailed descriptions thereof will be omitted.

Figure 32:
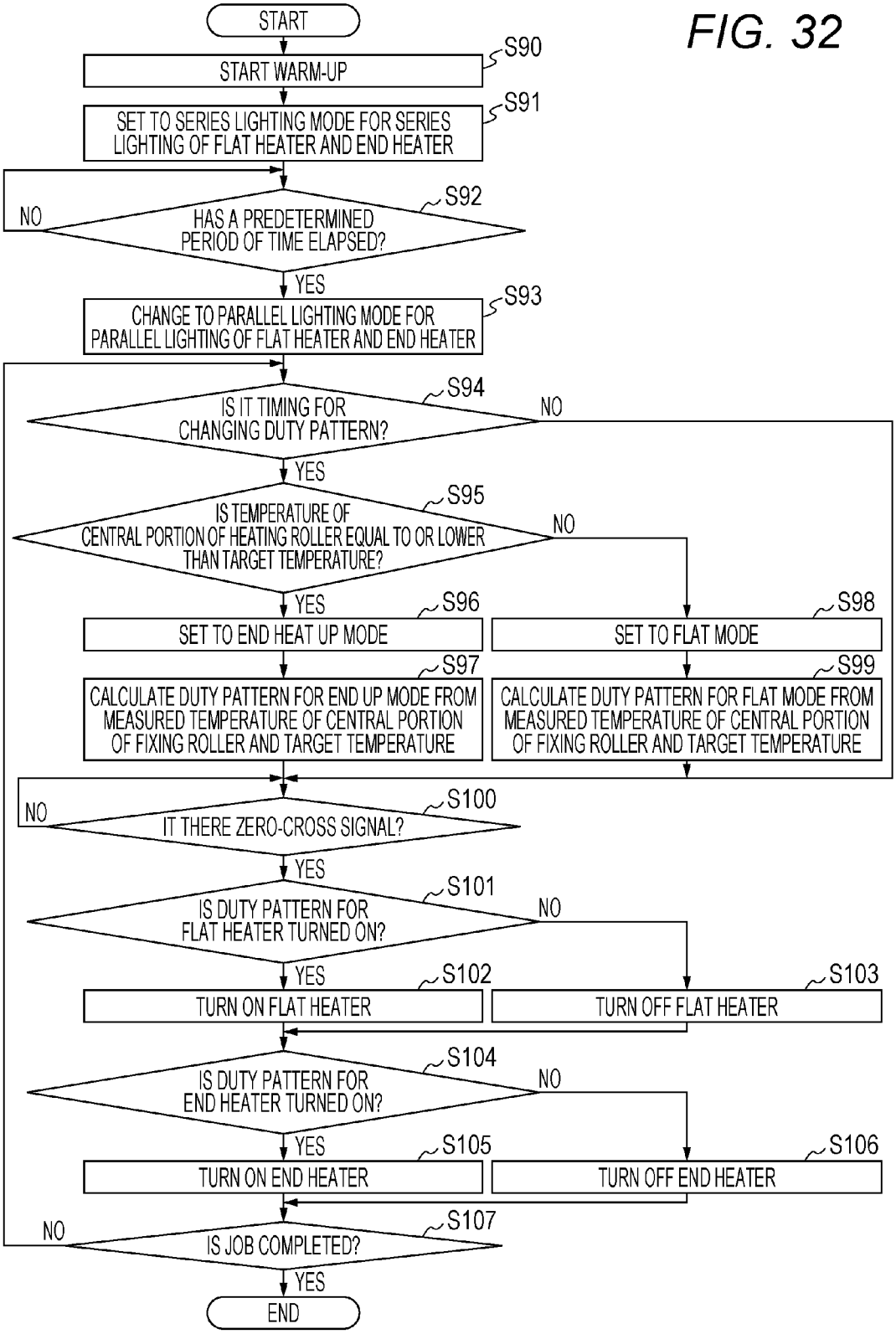
FIG. 32 is a flowchart of exemplary operations by an image forming apparatus in a fixing process according to a sixth embodiment.

FIG. 32 is a flowchart of exemplary operations of the fixing device 200F according to the sixth embodiment of the present invention. The lighting controls of the flat heater 220 and others except for step S95 is the same as that of the flat heater 220 and others in steps S10 to S14 and S16 to S27 in the first embodiment, and thus detailed descriptions thereof will be omitted.

In step S95, the central temperature detection unit 222 detects the temperature of the central portion of the heating roller 202. The control unit 250 acquires the temperature of the central portion of the heating roller 202 detected by the central temperature detection unit 222, and determines whether the temperature of the central portion of the heating roller 202 is equal to or lower than a preset target temperature. The target temperature is set to 20° C., for example, and is recorded in advance in the memory 254. The target temperature can be set to an arbitrary temperature by the user on the setting screen of the operation display part 70.

When the temperature of the central portion of the heating roller 202 is equal to or lower than the target temperature, the control unit 250 estimates that the temperature of the end portions of the heating roller 202 is lowered as well as the temperature of the central portion of the heating roller 202, and then moves the process to step S96. Meanwhile, when the temperature of the central portion of the heating roller 202 is higher than the target temperature, the control unit 250 estimates that the temperature of the end portions of the heating roller 202 is not lowered, that is, the temperature of the heating roller 202 is kept uniform, and moves the process to step S98.

When the temperature of the central portion of the heating roller 202 is equal to or lower than the target temperature, the control unit 250 sets the lighting mode of the fixing device 200F to the end heat up mode in step S96. In the end heat up mode, the control unit 250 subjects the flat heater 220 to lighting control in a duty pattern at a duty ratio between 33.33% and 80% or turns off the flat heater 220, and subjects the end heater 230 to lighting control in a duty pattern at a duty ratio between 33.33% and 100%.

Meanwhile, when the temperature of the central portion of the heating roller 202 is higher than the target temperature, the control unit 250 sets the lighting mode of the fixing device 200F to the flat mode in step S98. In the flat mode, the control unit 250 subjects the flat heater 220 to lighting control in a duty pattern at a duty ratio between 33.33% and 100% and subjects the end heater 230 to lighting control in a duty pattern at a duty ratio between 33.33% and 80% or turns off the end heater 230.

As described above, according to the sixth embodiment, it is possible to produce the same advantages as those of the first embodiment. In addition, according to the sixth embodiment, even when the end temperature detection unit 232 is not provided, the temperature of the end portions of the heating roller 202 can be estimated from the temperature of the central portion of the same. This allows the optimum lighting control of the heaters in a simpler device configuration and at lower costs.

The technical scope of the present invention is not limited by the foregoing embodiments but includes various modifications of the foregoing embodiments without deviating from the gist of the present invention. In the foregoing embodiments, the present invention is applied to the image forming apparatus 100 configured to form color images. However, the present invention is also applicable to an image forming apparatus configured to form black-and-white images. In addition, the fixing device 200A and others are provided with the control unit 250. Alternatively, the control unit 250 is configured separately from the fixing device 200A and others within the image forming apparatus 100.

According to an embodiment of the present invention, based on the temperature of the end portions of the roller in the longitudinal side, one of the heaters is subjected to full-lighting control and the other heater is subjected to lighting control in a pattern at a predetermined duty ratio, or one of the heaters is subjected to lighting control in a pattern at a predetermined duty ratio and the other heater is turned off. This makes it possible to keep the temperature of the roller uniform in an effective manner and reduce a control load during lighting control.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A fixing device comprising:

a roller that fixes an image onto paper;

a plurality of heaters provided within the roller, the plurality of heaters being different from each other with respect to distribution of a heat supply amount along a longitudinal side of the roller;

a temperature detection unit that detects a temperature of the roller; and a control unit that performs lighting control on the heaters in patterns of half-wave cycles of an alternating-current power source according to a result of the detection by the temperature detection unit, wherein when the temperature detection unit detects that the temperature of end portions of the roller along the longitudinal side is lower than a preset reference temperature, the control unit (i) performs full-lighting control on the heater from among the plurality of heaters with the largest amount of heat supply to the end portions of the roller, and performs lighting control on the heater from among the plurality of heaters with the second largest amount of heat supply to the end portions of the roller, in a pattern at a predetermined duty ratio, or (ii) performs lighting control on the heater with the largest amount of heat supply to the end portions of the roller in a pattern at a predetermined duty ratio, and turns off the heater with the second largest amount of heat supply to the end portions of the roller.

2. The fixing device according to claim 1, wherein when the temperature detection unit detects that the temperature of the end portions of the roller along the longitudinal side is higher than the reference temperature, the control unit (i) performs full-lighting control on the heater from among the plurality of heaters with the least amount of heat supply to the end portions of the roller, and performs lighting control on the heater from among the plurality of heaters with the second least amount of heat supply to the end portions of the roller, in a pattern at a predetermined duty ratio, or (ii) performs lighting control on the heater with the least amount of heat supply to the end portions of the roller, in a pattern at a predetermined duty ratio, and turns off the heater with the second least amount of heat supply to the end portions of the roller.

3. The fixing device according to claim 1, wherein:

the temperature detection unit detects the temperature of a central portion of the roller, the fixing device further includes an end temperature detection unit that detects the temperature of the end portions of the roller along the longitudinal side, and the control unit selects the lighting control to be executed when the temperature of the end portions of the roller is lower than the reference temperature or the lighting control to be executed when the temperature of the end portions of the roller is higher than the reference temperature, according to a result of the detection by the end temperature detection unit.

4. The fixing device according to claim 1, wherein:

the temperature detection unit detects the temperature of a central portion of the roller, and the control unit estimates the temperature of the end portions of the roller from an off time during which the heaters are turned off, and selects the lighting control to be executed when the temperature of the end portions of the roller is lower than the reference temperature or the lighting control to be executed when the temperature of the end portions of the roller is higher than the reference temperature, according to a result of the estimation.

5. The fixing device according to claim 1, wherein:

the temperature detection unit detects the temperature of a central portion of the roller, and the control unit estimates the temperature of the end portions of the roller from an on time during which the heaters are turned on, and selects the lighting control to be executed when the temperature of the end portions of the roller is lower than the reference temperature or the lighting control to be executed when the temperature of the end portions of the roller is higher than the reference temperature, according to a result of the estimation.

6. The fixing device according to claim 1, wherein:

the temperature detection unit detects the temperature of a central portion of the roller, and the control unit selects the lighting control to be executed when the temperature of the end portions of the roller is lower than the reference temperature or the lighting control to be executed when the temperature of the end portions of the roller is higher than the reference temperature, according to a size of paper on which an image is to be formed, the size of the paper being used to estimate the temperature of the end portions of the roller.

7. The fixing device according to claim 1, wherein:

the temperature detection unit detects the temperature of a central portion of the roller, and the control unit estimates the temperature of the end portions of the roller from the temperature of the central portion of the roller detected by the temperature detection unit, and selects the lighting control to be executed when the temperature of the end portions of the roller is lower than the reference temperature or the lighting control to be executed when the temperature of the end portions of the roller is higher than the reference temperature, according to a result of the estimation.

8. The fixing device according to claim 1, wherein, in lighting of the plurality of heaters, the control unit subjects the plurality of heaters to series lighting and then subjects the plurality of heaters to parallel lighting.

9. An image forming apparatus comprising:

an image forming part that forms an image on paper; and the fixing device according to claim 1, the fixing device fixing the image formed by the image forming part onto the paper.

10. The fixing device according to claim 2, wherein:

the temperature detection unit detects the temperature of a central portion of the roller, the fixing device further includes an end temperature detection unit that detects the temperature of the end portions of the roller along the longitudinal side, and the control unit selects the lighting control to be executed when the temperature of the end portions of the roller is lower than the reference temperature or the lighting control to be executed when the temperature of the end portions of the roller is higher than the reference temperature, according to a result of the detection by the end temperature detection unit.

11. The fixing device according to claim 2, wherein:

the temperature detection unit detects the temperature of a central portion of the roller, and the control unit estimates the temperature of the end portions of the roller from an off time during which the heaters are turned off, and selects the lighting control to be executed when the temperature of the end portions of the roller is lower than the reference temperature or the lighting control to be executed when the temperature of the end portions of the roller is higher than the reference temperature, according to a result of the estimation.

12. The fixing device according to claim 2, wherein:

the temperature detection unit detects the temperature of a central portion of the roller, and the control unit estimates the temperature of the end portions of the roller from an on time during which the heaters are turned on, and selects the lighting control to be executed when the temperature of the end portions of the roller is lower than the reference temperature or the lighting control to be executed when the temperature of the end portions of the roller is higher than the reference temperature, according to a result of the estimation.

13. The fixing device according to claim 2, wherein:

the temperature detection unit detects the temperature of a central portion of the roller, and the control unit selects the lighting control to be executed when the temperature of the end portions of the roller is lower than the reference temperature or the lighting control to be executed when the temperature of the end portions of the roller is higher than the reference temperature, according to a size of paper on which an image is to be formed, the size of the paper being used to estimate the temperature of the end portions of the roller.

14. The fixing device according to claim 2, wherein:

the temperature detection unit detects the temperature of a central portion of the roller, and the control unit estimates the temperature of the end portions of the roller from the temperature of the central portion of the roller detected by the temperature detection unit, and selects the lighting control to be executed when the temperature of the end portions of the roller is lower than the reference temperature or the lighting control to be executed when the temperature of the end portions of the roller is higher than the reference temperature, according to a result of the estimation.

15. The fixing device according to claim 2, wherein, in lighting of the plurality of heaters, the control unit subjects the plurality of heaters to series lighting and then subjects the plurality of heaters to parallel lighting.

16. An image forming apparatus comprising:

an image forming part that forms an image on paper; and the fixing device according to claim 2, the fixing device fixing the image formed by the image forming part onto the paper.

* * * * *